US010728979B1

(12) United States Patent
Suttles et al.

(10) Patent No.: US 10,728,979 B1
(45) Date of Patent: Jul. 28, 2020

(54) LIGHTING FIXTURE CONFIGURED TO PROVIDE MULTIPLE LIGHTING EFFECTS

(71) Applicant: ABL IP Holding LLC, Atlanta, GA (US)

(72) Inventors: Benjamin Marshall Suttles, McDonough, GA (US); Daniel Aaron Weiss, Tucker, GA (US)

(73) Assignee: ABL IP Holding LLC, Atlanta, GA (US)

( * ) Notice: Subject to any disclaimer, the term of this patent is extended or adjusted under 35 U.S.C. 154(b) by 0 days.

(21) Appl. No.: 16/587,433

(22) Filed: Sep. 30, 2019

(51) Int. Cl.
*H05B 37/02* (2006.01)
*H05B 45/20* (2020.01)
*H05B 47/18* (2020.01)

(52) U.S. Cl.
CPC ..... *H05B 45/20* (2020.01); *H05B 47/18* (2020.01)

(58) Field of Classification Search
CPC ..... H05B 37/0245; H05B 37/0254; H05B 37/0263; H05B 37/0281; H05B 33/0845; H05B 33/0857
USPC ..... 315/192, 294, 307
See application file for complete search history.

(56) References Cited

U.S. PATENT DOCUMENTS 6,168,299 B1 1/2001 Yan
6,234,648 B1 5/2001 Borner et al.
6,985,163 B2 1/2006 Riddle et al.
7,119,500 B2 10/2006 Young
7,119,501 B2 10/2006 Young
7,178,941 B2 2/2007 Roberge et al.
7,288,902 B1 10/2007 Melanson
7,358,929 B2 4/2008 Mueller et al.
7,649,322 B2 1/2010 Neuman et al.
7,764,028 B2 7/2010 Mariyama et al.
(Continued)

FOREIGN PATENT DOCUMENTS

CA 2767985 1/2011
CA 2964005 10/2017
(Continued)

OTHER PUBLICATIONS

6' IC LED Retrofit Warmdim (TM) Downlight Trim, Juno, Oct. 2012, 2 pages.
(Continued)

*Primary Examiner* — Tung X Le
(74) *Attorney, Agent, or Firm* — Kilpatrick Townsend & Stockton LLP

(57) ABSTRACT

A lighting fixture may provide a proximal lighting effect and a distal lighting effect. In some cases, the lighting fixture may include a multi-channel driver and multiple groups of LEDs. Based on an adjustable input level, the driver may provide current to subgroups of the LEDs, arranged at various areas of the lighting fixture. Responsive to the level of the input, the driver may provide current to various LED subgroups at the various areas, such that a particular proximal effect is provided at a particular area of the lighting fixture based on the particular value of the input level. In addition, the distal lighting effect may have a stable value across the adjustments to the input level, and the corresponding adjustments to the proximal effects. The distal effect may be perceivable at a location remote from the lighting fixture, such as a work surface.

23 Claims, 8 Drawing Sheets

(56) References Cited

U.S. PATENT DOCUMENTS 7,902,560 B2 3/2011 Bierhuizen et al.
7,902,761 B2 3/2011 Ang et al.
7,959,332 B2 6/2011 Tickner et al.
7,982,409 B2 7/2011 Hasnain et al.
8,008,850 B2 8/2011 Su et al.
8,018,172 B2 9/2011 Leshniak
8,022,634 B2 9/2011 Greenfeld
8,096,686 B2 1/2012 Wilcox
8,118,441 B2 2/2012 Hessling
8,203,260 B2 6/2012 Li et al.
8,227,996 B2 7/2012 Leshniak
8,278,832 B2 10/2012 Hung et al.
8,324,815 B2 12/2012 Maxik et al.
8,324,823 B2 12/2012 Choi et al.
8,324,840 B2 12/2012 Shteynberg et al.
8,334,658 B2 12/2012 Balakrishnan
8,358,089 B2 1/2013 Hsia et al.
8,436,549 B2 5/2013 Hasnain
8,441,202 B2 5/2013 Wilson et al.
8,441,205 B2 5/2013 Hsieh et al.
8,441,213 B2 5/2013 Huynh
8,471,481 B2 6/2013 Shin et al.
8,476,829 B2 7/2013 Maxik et al.
8,491,159 B2 7/2013 Recker et al.
8,598,804 B2 12/2013 Foxall et al.
8,629,629 B2 1/2014 Hariharan
8,633,650 B2 1/2014 Sauerlaender
8,653,752 B2 2/2014 Sakuragi et al.
8,686,651 B2 4/2014 Lynch et al.
8,698,416 B2 4/2014 Pan
8,702,271 B2 4/2014 Rains, Jr. et al.
8,704,460 B2 4/2014 Hariharan
8,710,754 B2 4/2014 Baddela et al.
8,716,946 B2 5/2014 Lee et al.
8,736,183 B2 5/2014 Chao
8,760,262 B2 6/2014 Veskovic
8,766,555 B2 7/2014 Tu et al.
8,773,337 B2 7/2014 Li et al.
8,779,675 B2 7/2014 Mikani et al.
8,783,887 B2 7/2014 Caruso et al.
8,783,901 B2 7/2014 Zoorob et al.
8,810,140 B2 8/2014 Huynh
8,823,289 B2 9/2014 Linz et al.
8,829,822 B2 9/2014 Laski et al.
8,841,864 B2 9/2014 Maxik et al.
8,847,477 B2 9/2014 Kawashima et al.
8,872,438 B2 10/2014 Zhou et al.
8,890,419 B2 11/2014 Stack
8,901,835 B2 12/2014 Kang et al.
8,928,249 B2 1/2015 Raj et al.
9,000,678 B2 4/2015 Huynh
9,055,650 B2 6/2015 Steedly
9,125,270 B2 9/2015 Liao et al.
9,131,571 B2 9/2015 Zhang et al.
9,143,051 B2 9/2015 Newman, Jr.
9,144,127 B1 9/2015 Yu et al.
9,144,128 B2 9/2015 Shin et al.
9,161,412 B2 10/2015 Lou et al.
9,189,996 B2 11/2015 Casper et al.
9,247,597 B2 1/2016 Miskin et al.
9,301,353 B2 3/2016 Park et al.
9,301,355 B2 3/2016 Zhao
9,307,604 B2 4/2016 Sun et al.
9,326,343 B2 4/2016 Yan et al.
9,345,094 B2 5/2016 Lee et al.
9,414,452 B1 8/2016 Cheng et al.
9,414,457 B2 8/2016 Fukuda et al.
9,451,662 B1 9/2016 Chung et al.
9,456,478 B2 9/2016 Rodriguez et al.
9,468,062 B2 10/2016 Rybicki et al.
9,472,593 B2 10/2016 Hasnain et al.
9,480,116 B2 10/2016 Vissenberg et al.
9,491,821 B2 11/2016 Shackle
9,538,603 B2 1/2017 Shearer et al.
9,562,671 B2 2/2017 Davis
9,596,730 B1 3/2017 Ciccarelli et al.
9,618,184 B2 4/2017 Buchholz et al.
9,644,828 B1 5/2017 May
9,648,673 B2 5/2017 Pickard et al.
9,736,904 B2 8/2017 Casper et al.
9,844,114 B2 12/2017 Chowdhury et al.
9,854,637 B2 12/2017 Ciccarelli et al.
9,900,957 B2 2/2018 van de Ven et al.
9,913,343 B1 3/2018 Ciccarelli et al.
9,955,551 B2 4/2018 Spero
10,091,856 B2 10/2018 Ciccarelli et al.
10,187,952 B2 1/2019 Ciccarelli et al.
2003/0016536 A1 1/2003 Lin
2007/0138978 A1 6/2007 Rains, Jr. et al.
2007/0195552 A1* 8/2007 Park ..... H05B 33/0818 362/613
2008/0094000 A1 4/2008 Yamamoto et al.
2008/0225520 A1 9/2008 Garbus
2008/0258643 A1 10/2008 Cheng et al.
2009/0002986 A1 1/2009 Medendorp, Jr. et al.
2009/0026913 A1 1/2009 Mrakovich
2009/0195186 A1 8/2009 Guest et al.
2009/0296368 A1 12/2009 Ramer
2010/0061108 A1 3/2010 Zhang et al.
2010/0084992 A1 4/2010 Valois et al.
2010/0110699 A1 5/2010 Chou
2010/0148672 A1 6/2010 Hopper
2010/0172152 A1 7/2010 Boonekamp
2010/0225241 A1 9/2010 Maehara et al.
2010/0244713 A1 9/2010 Lee et al.
2010/0259918 A1 10/2010 Rains, Jr. et al.
2010/0277316 A1 11/2010 Schlangen et al.
2010/0295460 A1 11/2010 Lin et al.
2010/0308739 A1 12/2010 Shteynberg et al.
2010/0308749 A1 12/2010 Liu
2011/0050125 A1 3/2011 Medendorp, Jr. et al.
2011/0074292 A1 3/2011 Maehara
2011/0075414 A1 3/2011 Van De Ven et al.
2011/0075422 A1 3/2011 Van De Ven et al.
2011/0101883 A1 5/2011 Grajcar
2011/0115391 A1 5/2011 Chao et al.
2011/0170289 A1 7/2011 Allen et al.
2011/0182065 A1 7/2011 Negley et al.
2011/0187290 A1* 8/2011 Krause ..... H05B 47/18 315/312
2011/0193467 A1 8/2011 Grajcar
2011/0199753 A1 8/2011 Ramer et al.
2011/0227489 A1 9/2011 Huynh
2011/0241551 A1 10/2011 McRae
2011/0273102 A1 11/2011 van de Ven et al.
2011/0316440 A1 12/2011 Leshniak
2012/0020092 A1 1/2012 Bailey
2012/0038286 A1 2/2012 Hasnain
2012/0038291 A1 2/2012 Hasnain
2012/0056556 A1 3/2012 Laski et al.
2012/0112661 A1 5/2012 Van de Ven et al.
2012/0119658 A1 5/2012 McDaniel
2012/0134133 A1 5/2012 Kang
2012/0229030 A1 9/2012 Moskowitz et al.
2012/0280635 A1 11/2012 Lu et al.
2012/0300452 A1 11/2012 Harbers et al.
2013/0002167 A1 1/2013 Van de Ven
2013/0015774 A1* 1/2013 Briggs ..... H05B 33/0815 315/186
2013/0113394 A1 5/2013 Ido et al.
2013/0119882 A1 5/2013 Mao et al.
2013/0147387 A1 6/2013 Murdock
2013/0223079 A1 8/2013 Jung et al.
2013/0294058 A1 11/2013 Lou et al.
2013/0307423 A1 11/2013 Lee
2014/0063779 A1 3/2014 Bradford
2014/0232288 A1 8/2014 Brandes et al.
2014/0232297 A1 8/2014 Chobot
2014/0254171 A1 9/2014 Greiner
2014/0265882 A1 9/2014 Laski et al.
2014/0300283 A1 10/2014 Lee et al.
2014/0300284 A1 10/2014 Lee et al.
2014/0312777 A1 10/2014 Shearer et al.
2014/0328045 A1 11/2014 Valteau et al.

(56) References Cited

U.S. PATENT DOCUMENTS

| | | | | |
|---|---|---|---|---|
| 2014/0361696 | A1 | 12/2014 | Siessegger et al. | |
| 2015/0002045 | A1 | 1/2015 | Hwang et al. | |
| 2015/0036316 | A1 | 2/2015 | Lin et al. | |
| 2015/0084534 | A1 | 3/2015 | Fukuda et al. | |
| 2015/0091472 | A1 | 4/2015 | Kadotani et al. | |
| 2015/0115823 | A1 | 4/2015 | Serra et al. | |
| 2015/0173151 | A1 | 6/2015 | Ter Weeme et al. | |
| 2015/0245437 | A1 | 8/2015 | Cho et al. | |
| 2015/0247623 | A1 | 9/2015 | Hikmet et al. | |
| 2015/0264764 | A1 | 9/2015 | Choi et al. | |
| 2015/0271884 | A1 | 9/2015 | Kim et al. | |
| 2015/0282266 | A1 | 10/2015 | Hsing Chen et al. | |
| 2015/0289344 | A1 | 10/2015 | Leadford et al. | |
| 2015/0351190 | A1 | 12/2015 | Walters et al. | |
| 2015/0351193 | A1 | 12/2015 | Chao et al. | |
| 2016/0025273 | A1 | 1/2016 | van de Ven et al. | |
| 2016/0120001 | A1 | 4/2016 | Clark et al. | |
| 2016/0123564 | A1 | 5/2016 | Quilici et al. | |
| 2016/0128155 | A1* | 5/2016 | Petluri ..... | H05B 45/3577 315/294 |
| 2016/0174305 | A1 | 6/2016 | Kim et al. | |
| 2016/0302288 | A1* | 10/2016 | Gotoh ..... | G08C 23/04 |
| 2016/0381750 | A1 | 12/2016 | Bong et al. | |
| 2017/0064785 | A1 | 3/2017 | Kim et al. | |
| 2017/0219170 | A1 | 8/2017 | Petluri et al. | |
| 2018/0153015 | A1 | 5/2018 | Ciccarelli et al. | |
| 2018/0160491 | A1* | 6/2018 | Biery ..... | H05B 45/22 |
| 2018/0267223 | A1 | 9/2018 | Rodgers et al. | |
| 2019/0104577 | A1 | 4/2019 | Miller et al. | |
| 2019/0141802 | A1* | 5/2019 | Saes ..... | F21S 2/005 |
| 2019/0306949 | A1* | 10/2019 | Murray ..... | H05B 33/0827 |

FOREIGN PATENT DOCUMENTS

| | | |
|---|---|---|
| CA | 2960262 | 12/2017 |
| EP | 3247174 | 11/2017 |
| KR | 2020100009895 | 10/2010 |
| WO | 2006018604 | 2/2006 |

OTHER PUBLICATIONS

Sun, Challenges and Opportunities for High Power White LED Development, DOE SSL R&D Workshop, Feb. 1, 2012, pp. 1-12.

* cited by examiner

LIGHTING FIXTURE CONFIGURED TO PROVIDE MULTIPLE LIGHTING EFFECTS

TECHNICAL FIELD

This disclosure relates generally to the field of variable lighting fixtures, and more specifically relates to techniques to provide variable combinations of lighting effects.

BACKGROUND

Lighting trends in residential and commercial applications are taking advantage of increased control of lighting effects offered by LED light fixtures. There is a demand for light sources that produce light that is adjustable across various effects, such as color, correlated color temperature (CCT or color temperature), circadian effect, or spatial distribution. In addition, there is a demand for light sources that provide functional light, such as an even white light at a work surface, while also providing aesthetically pleasing visual effects, such as colorful effects visible at the light source.

A light source may be configured to provide multiple colors, or other light effects, that are controllable, such as via an adjustable switch. Current techniques to provide multiple controllable effects include configuring a microcontroller or a multi-channel driver to provide power to groups of LEDs, to provide the multiple effects. In a conventional multi-effect lighting fixture that uses a multi-channel driver, each effect may be provided via two channels of the driver, such as two channels to provide a dimmable red color and two additional channels to provide a dimmable blue color. In addition, a conventional multi-effect lighting fixture that uses a microprocessor may provide each effect via a programmed channel of the microprocessor. However, the inclusion of a driver with additional pairs of channels for each additional lighting effect, or the inclusion of a microprocessor, may increase the size, cost, or manufacturing complexity of a conventional lighting fixture.

It is beneficial to develop a lighting fixture that provides multiple adjustable effects via a driver with fewer channels, to reduce cost, size, and manufacturing complexity of the multi-effect lighting fixture.

SUMMARY

According to certain implementations, a lighting fixture includes a driver with multiple channels, and multiple pluralities of LEDs that are capable of providing respective lighting effects. The driver is configured to provide current to the channels based on an input. A first group of LEDs from a first plurality and a second group of LEDs from a second plurality are configured to receive current via a first channel. A third group of LEDs from the first plurality and a fourth group of LEDs from the second plurality are configured to receive current via a second channel. The driver is configured to provide current to the first channel responsive to a first level of the input, such that the first group of LEDs provides a first lighting effect at a first area of the lighting fixture and the second group of LEDs provides a second lighting effect at a second area of the lighting fixture. The driver is further configured to provide current to the second channel responsive to a second level of the input, such that the third group of LEDs provides the first lighting effect at the second area and the fourth group of LEDs provides the second lighting effect at the first area. In addition, a combined lighting effect, based on a combination of the first and second lighting effects, may be provided at a location that is remote from the lighting fixture. The combined lighting effect may have a stable value (e.g., a same value) across adjustments to the level of the input.

These illustrative implementations are mentioned not to limit or define the disclosure, but to provide examples to aid understanding thereof. Additional implementations are discussed in the Detailed Description, and further description is provided there.

BRIEF DESCRIPTION OF THE DRAWINGS

Features, implementations, and advantages of the present disclosure are better understood when the following Detailed Description is read with reference to the accompanying drawings, where.

DETAILED DESCRIPTION

Figure 1A:
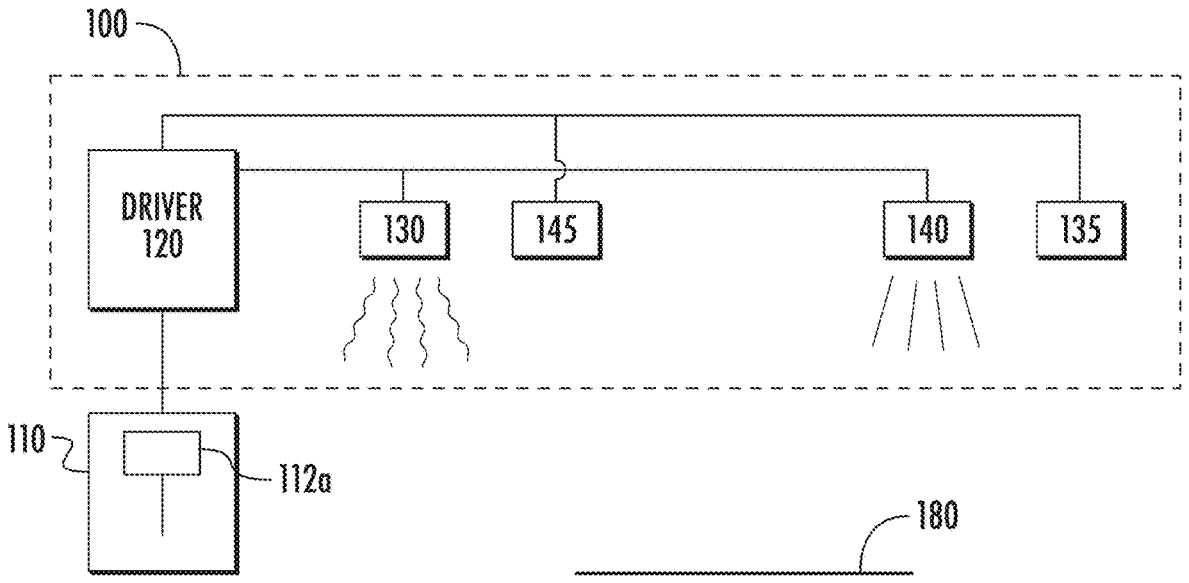
FIGS. 1A and 1B, collectively referred to herein as FIG. 1, are block diagrams depicting examples of lighting fixtures capable of providing multiple adjustable lighting effects, according to certain implementations.

As discussed above, prior techniques for providing multiple adjustable lighting effects may require inclusion of relatively expensive microprocessors or drivers with a large number of channels. Certain implementations described herein provide for multiple lighting effects that are adjustable, such as multiple colors. For example, a lighting fixture may include a driver with two channels. The two-channel driver may be configured to control groups of LEDs to provide the multiple effects. In addition, the driver may be configured to adjust the multiple effects based on a given input, such as an input received from an adjustable switch. In some implementations, a lighting fixture that includes a two-channel driver configured to provide multiple adjustable lighting effects may be less expensive or less complex (or both) to manufacture, as compared to a conventional fixture which uses multiple drivers, or a driver with more than two channels, to provide multiple effects. In addition, a lighting fixture that includes a two-channel driver configured to provide multiple adjustable lighting effects may be less expensive or less complex (or both) to manufacture, as compared to a conventional fixture which uses a microcontroller to provide multiple effects.

In some implementations, the lighting fixture may include multiple groups of LEDs that are capable of providing respective lighting effects, such as a component lighting effect. In addition, the groups may be arranged in multiple areas within the lighting fixture, such that the lighting effect for each group is provided at or around a respective area of the lighting fixture, and a combination of the lighting effects is perceived at an additional area of the lighting fixture. In addition, the combination of the component lighting effects may be provided at a location that is remote from the lighting fixture, such as a work surface located below the lighting fixture. In some implementations, the two-channel driver is configured to adjust the component lighting effect for each group, while the combined lighting effect remains at a stable value. As an example, the two-channel driver may adjust contrasting color effects for groups of LEDs, while the combined color effect of the groups remains at or around a white color that is suitable for task lighting. In some cases, a lighting fixture that provides adjustable component effects and a stable combined lighting effect has improved aesthetic appeal and improved functionality, as compared to conventional fixtures that provide either a functional effect without adjustable component effects, or adjustable component effects without a functional effect.

The following examples are provided to introduce certain implementations of the present disclosure. For example, a lighting fixture may include a driver with two channels. The two-channel driver may be configured to control groups of LEDs to provide the multiple effects. In addition, the driver may be configured to adjust the multiple effects based on a given input, such as an input received from an adjustable switch. In some cases, the lighting fixture may include multiple groups of LEDs. The groups may be capable of providing the multiple lighting effects, such as a first group of LEDs that is capable of providing a first effect and a second group that is capable of providing a second effect. Subgroups of the LEDs may be configured to receive current via one of the two channels of the driver. For example, a first subgroup having the first effect and a second subgroup having the second effect may be controlled via a first channel from the driver. A third subgroup having the first effect and a fourth subgroup having the second effect may be controlled via a second channel from the driver. In addition, the subgroups may be arranged in multiple areas within the lighting fixture, such that the lighting effect for a particular subgroup is provided at or around a particular area of the lighting fixture. In some cases, subgroups that are controlled via a particular channel are arranged in separate areas of the lighting fixture. Continuing with the above example, the first and second subgroups (e.g., controlled via the first channel) may be arranged in separate areas of the fixture. In addition, the third and fourth subgroups (e.g., controlled via the second channel) may be arranged in separate areas of the fixture. In some cases, the driver is configured to provide an electrical value, such as a current value or voltage value, via one or more of the first and second channels, such that the subgroups provide the first and second lighting effects at the respective separate areas.

Continuing with the above example, multiple lighting effects may be provided by the lighting fixture. The multiple lighting effects may include one or more proximal lighting effects that are provided at the areas of the lighting fixture, such as at the respective areas of the subgroups, or at an additional area that is in between the respective areas. For example, and not by way of limitation, a proximal lighting effect could include a color that is produced at an aperture of the lighting fixture, a lighting distribution that is directed from the aperture, or other lighting effects that are provided at the aperture. In addition, the multiple lighting effects may include one or more distal effects that are provided at a location that is remote from the lighting fixture, such as a work surface located below the lighting fixture. For example, and not by way of limitation, a distal lighting effect could include a combination of colors that is produced at an distance from the lighting fixture, a combined lighting distribution that is a combination of distributions directed from multiple areas of the aperture, or other lighting effects that are provided at a distance away from the aperture. In some implementations, the distal lighting effect may remain stable across adjustments to the proximal lighting effects.

As used herein, the term "visible" refers to a lighting effect that is visually perceptible by a person who is viewing a source of the lighting effect (e.g., a lighting fixture, an area of a lighting fixture). A "visually discernable" or "visually distinct" lighting effect refers to a visible lighting effect that is discernable by a person who is viewing the lighting effect at a distance, such as across a room, or from a floor to a ceiling (e.g., a distance of about 3-5 m). A lighting fixture may provide multiple component lighting effects. As used herein, a visually discernable or visually distinct component lighting effect is perceptible by a human as having separate characteristics from other component lighting effects. For example, a person viewing multiple lighting effects provided by a lighting fixture may perceive three visually distinct component lighting effects, such as three distinct colors of light.

As used herein, the term "proximal" refers to a lighting effect that is provided at an aperture of a lighting fixture providing the lighting effect. The proximal effect may be produced within an effect range from the aperture, such as at a distance of about 0-20 cm. As used herein, the term "distal" refers to a lighting effect that is provided at a distance from a lighting fixture providing the lighting effect. The distal effect may be produced outside of the effect range from the aperture, such as at a distance greater than about 20 cm. A particular lighting fixture may produce a proximal effect and a distal effect simultaneously, such as by providing light (e.g., via multiple groups of LEDs) that combines to produce various effects at various distances from the lighting fixture.

In some cases, a proximal lighting effect may be an aesthetic effect, such as an aesthetic effect interpretable by a person as a primarily decorative characteristic. In addition, a distal lighting effect may be a functional effect, such as a functional effect interpretable by a person as a primarily useful characteristic. A functional lighting effect may enable a user of a lighting fixture to perform tasks with accuracy or efficiency, such as bright white task lighting. An aesthetic lighting effect may provide enjoyment to a user of a lighting fixture, such as an enjoyable color combination of light. A functional or aesthetic characteristic may be dependent upon the use of the lighting fixture. For example, light having a dull red color may be an aesthetic effect in a living room, and a functional effect in a photography darkroom.

Figure 1B:
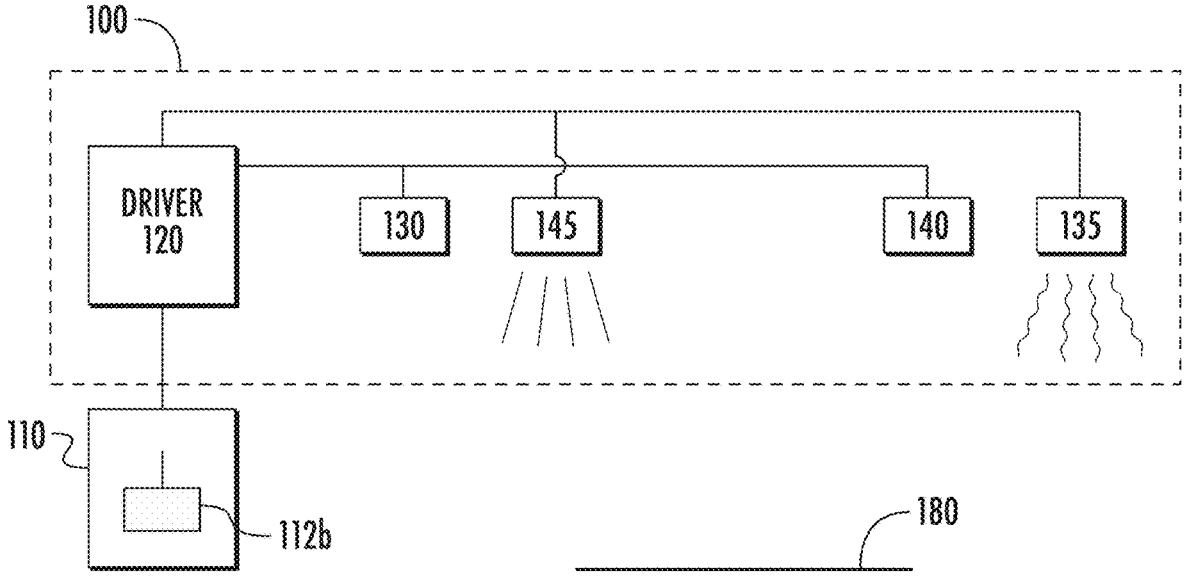

Referring now to the drawings, FIG. 1 is a diagram depicting an example implementation in which a lighting fixture 100 provides multiple adjustable lighting effects. In FIG. 1A and FIG. 1B (collectively referred to herein as FIG. 1), the lighting fixture 100 includes a driver 120 and multiple groups of LEDs, such as group 130, 135, 140, and 145. The LED groups are capable of producing light that has one or more lighting effects. For example, groups 130 and 135 may each be capable of producing light having a first effect. In addition, groups 140 and 145 may each be capable of producing light having a second effect. The lighting effects may be a characteristic of light emitted by the group of LEDs, such as a color, a color temperature, a circadian effect, a tint, a color rendering index (CRI), a TM-30 metric, an optical distribution (such as a wide or narrow range into which light is emitted), a distribution angle (such as a direction towards which light is emitted), or any other suitable lighting characteristic. In some cases, an LED group produces a lighting effect that includes multiple characteristics of light, such as an effect of a blue color with a high distribution angle (e.g., blue light emitted at a relatively high angle). Although FIG. 1 depicts the lighting fixture 100 as including LED groups by which a multiple lighting effects are provided, other implementations are possible. For example, a lighting fixture may provide multiple lighting effects via incandescent bulbs, fluorescent lighting elements, halogen bulbs, or other suitable lighting emitters.

In the lighting fixture 100, the driver 120 may be configured to provide power to the LED groups 130, 135, 140, and 145. The driver 120 may include two channels via which power (e.g., an electrical voltage, an electrical current) is provided to the LED groups. For example, groups 130 and 140 may be configured to receive power via a first channel of the driver 120. In addition, groups 145 and 135 may be configured to receive power via a second channel of the driver 120. In some cases, the lighting fixture 100 is configured such that each channel of the driver 120 provides power to multiple groups of LEDs that provide respective lighting effects. For example, the first channel of driver 120 may be configured to provide power to group 130, having the first lighting effect, and to group 140, having the second lighting effect. In addition, the second channel of driver 120 may be configured to provide power to group 135, having the first lighting effect, and to group 145, having the second lighting effect. In some implementations, groups of LEDs that receive power via a particular channel are arranged in multiple areas of a lighting fixture. For example, FIG. 1 depicts groups 130 and 140 as being arranged in multiple respective areas of the lighting fixture 100. In addition, FIG. 1 depicts groups 135 and 145 as being arranged in the multiple respective areas, such that groups 130 and 145 are arranged relatively closely together, and that groups 140 and 135 are arranged relatively closely together, and that the groups 130 and 145 are arranged relatively far apart from the groups 140 and 135.

In the lighting fixture 100, the driver 120 is configured to receive an input, such as an input from an adjustable switch 110. The adjustable switch 110 may be a dimmer, such as a switch that is configured to provide a level of input that is based on a position of a handle on the switch. Although FIG. 1 depicts the adjustable switch 110 as being a sliding switch, other implementations are possible. For example, the driver 120 may receive an input from a sliding switch, a rotary knob, a touchpad, buttons, an electronic interface representing the user's intended interactions with the system (e.g., a text message, an input from a software application), or other suitable types of adjustable switches. In some implementations, the driver 120 is configured to control the LED groups 130, 135, 140, and 145 based on a value of the input received from the switch 110. The input may have a range of values, such as from about 0% to about 100%. In addition, the input may be provided to the driver 120 as an electronic signal that is based on the input value, such as a signal of about 0 V based on the value of about 0%, or a signal of about 10 V based on the value of about 100%.

In some implementations, the switch 110 may be adjusted to a position 112*a*, such as depicted in FIG. 1A. The driver 120 may receive the input at a first value that is based on the position 112*a*. For example, and not by way of limitation, the first value based on position 112*a* may be a value of about 100%. Responsive to receiving the first input value, the driver 120 may provide power via the first channel and withhold power via the second channel. In addition, the LED groups 130 and 140 may emit light based on the power from the first channel, such that group 130 provides the first lighting effect and group 140 provides the second lighting effect. The LED groups 135 and 145 may emit little or no light, based on the power being withheld via the second channel. In some cases, the light produced responsive to the first value includes the first lighting effect at a first area and the second lighting effect in a second area. For example, as depicted in FIG. 1A, group 130 may emit a relatively warm color (e.g., yellow) at a first area and the group 140 may emit a relatively cool color (e.g., blue) at a second area. In some cases, the light produced responsive to the first value provides a combined lighting effect at a distance from the lighting fixture 100, such as outside of an effect range. The combined lighting effect may be provided at an additional area, such as a white color (e.g., combination of blue and yellow) that is visible at a work surface 180 located below the lighting fixture 100.

In addition, the switch 110 may be adjusted to a position 112*b*, such as depicted in FIG. 1B. The driver 120 may receive the input at a second value that is based on the position 112*b*. For example, and not by way of limitation, the second value based on position 112*b* may be a value of about 0%. Responsive to receiving the second input value, the driver 120 may provide power via the second channel and withhold power via the first channel. In addition, the LED groups 135 and 145 may emit light based on the power from the second channel, such that group 135 provides the first lighting effect and group 145 provides the second lighting effect. The LED groups 130 and 140 may emit little or no light, based on the power being withheld via the first channel. In some cases, the light produced responsive to the second value includes the first lighting effect at the second area and the second lighting effect in the first area. For example, as depicted in FIG. 1B, group 135 may emit the relatively warm color (e.g., yellow) at the second area and the group 145 may emit the relatively cool color (e.g., blue) at the first area. In some cases, the light produced responsive to the second value provides the combined lighting effect at the distance from the lighting fixture 100, such as outside of the effect range. The combined lighting effect may be provided at the additional area, such as the white color (e.g., combination of blue and yellow) that is visible at the work surface 180. In some cases, the work surface 180 experiences the same (or nearly the same) combined lighting effect in the depictions of FIGS. 1A and 1B. In some implementations, the lighting fixture 100 provides a particular distal lighting effect, such as a white light color at the work surface 180, while proximal lighting effects are adjusted, such as the first and second lighting effects emitted by various ones of the LED groups 130, 135, 140, and 145. In addition, the distal lighting effect may be based on a combination of the proximal lighting effects, as depicted in FIG. 1.

Figure 2:
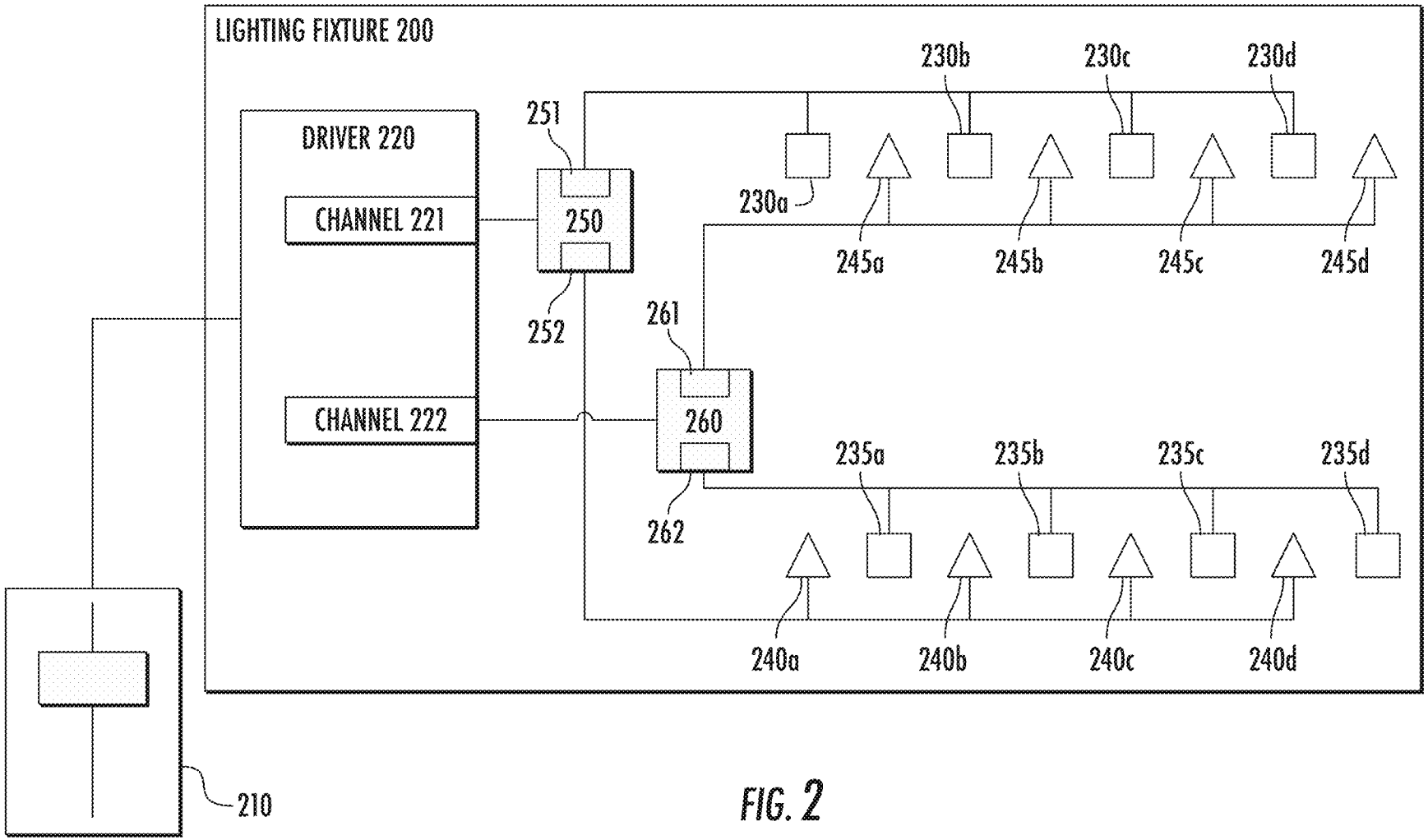
FIG. 2 is a block diagram depicting an example of a lighting fixture that is capable of providing multiple lighting effects via a two-channel driver, according to certain implementations.

FIG. 2 includes a block diagram depicting an example of a lighting fixture that is capable of providing multiple lighting effects. The lighting fixture 200 may include a two-channel driver 220, which includes a channel 221 and a channel 222. In addition, the lighting fixture 200 may include multiple emitters. For simplicity, the emitters included in the lighting fixture 200 are described as LEDs, but other implementations are possible. For example, each emitter may include a single LED, a group of LEDs manufactured separately, a group of LEDs manufactured together (e.g., chip-on-board), a bulb (e.g., incandescent, fluorescent), or other suitable types of light emitters.

The emitters in the lighting fixture 200 may provide multiple lighting effects. For example, the lighting fixture 200 may include a first plurality of LEDs that are capable of providing a first lighting effect. The first plurality of LEDs may include a subgroup 230, including LEDs 230*a*, 230*b*, 230*c*, and 230*d*. In addition, the first plurality of LEDs may include a subgroup 235, including LEDs 235*a*, 235*b*, 235*c*, and 235*d*. Each emitter in the subgroups 230 and 235 may be capable of providing the first lighting effect. The lighting fixture 200 may include a second plurality of LEDs that are capable of providing a second lighting effect. The second plurality of LEDs may include a subgroup 245, including LEDs 245*a*, 245*b*, 245*c*, and 245*d*. In addition, the second plurality of LEDs may include a subgroup 240, including LEDs 240*a*, 240*b*, 240*c*, and 240*d*. Each emitter in the subgroups 240 and 245 may be capable of providing the second lighting effect. For convenience, FIG. 2 depicts emitters in the subgroups 230 and 235 as squares, and emitters in the subgroups 240 and 245 as triangles. However, these diagrammatic shapes are non-limiting examples, and any suitable form factor may be used for an emitter.

In some implementations, emitters in the lighting fixture 200 are arranged in multiple areas of the fixture 200. For example, the subgroups 230 and 245 may be arranged in a first area, such as at a first end, at a central radius, or along a first edge of the fixture 200. In addition, the subgroups 240 and 235 may be arranged in a second area, such as at a second end, at an exterior radius, or along a second edge of the fixture 200. The areas may be separated within the light fixture 200. For example, the separated areas may be visually distinct such that a person viewing the fixture at a distance (e.g., across a room, from floor to ceiling) may visually discern a given lighting effect from emitters arranged at a given area.

The driver 220 may be configured to provide power to the multiple emitters via the channels 221 and 222. For example, the driver 220 may be configured to provide current to the subgroups 230 and 240 via the channel 221. In some cases, each LED in the subgroups 230 and 240 may be configured to receive current via a particular terminal of the channel 221. For example, a connection (e.g., wire, circuit board trace) from the channel 221 may be received by a circuit component having multiple output terminals associated with a given input terminal, such as a splitter 250. The LEDs in the subgroup 230 may receive current via a first split terminal 251 of the splitter 250. The LEDs in the subgroup 240 may receive current via a second split terminal 252 of the splitter 250. In addition, the driver 220 may be configured to provide current to the subgroups 235 and 245 via the channel 222. In some cases, each LED in the subgroups 235 and 245 may be configured to receive current via a particular terminal of the channel 222. For example, a connection from the channel 222 may be received by a circuit component having multiple output terminals, such as a splitter 260. The LEDs in the subgroup 245 may receive current via a first split terminal 261 of the splitter 260. The LEDs in the subgroup 235 may receive current via a second split terminal 262 of the splitter 260. Although FIG. 2 depicts the subgroups 230, 240, 235, and 245 as receiving current via the splitters 250 or 260, other configurations are possible. For example, emitter subgroups may receive current via multiple terminals of a particular channel, such as via split channel terminals that are included within the driver.

The lighting fixture 200 may be configured to receive an input, such as an input from an adjustable switch 210. The switch 210 may be configured to provide an input with an adjustable level, such as a level that is based on a position of a handle (or another user interface technique). For example, the switch 210 (or a handle of the switch 210) may have a range of possible positions (e.g., from a minimum position to a maximum position). The range of positions may be correlated with a range of input levels (e.g., from about 0% to about 100%). Based on the position, the switch 210 may provide an electrical signal that indicates the input level, such as a voltage between about 0 V to about 10 V. In FIG. 2, the electrical signal is described as a 0-10V voltage level, but other implementations are possible, such as additional voltage ranges, a differential voltage, a current level, a differential current, a sequence of bits, or other suitable electrical signals.

In some implementations, the driver 220 may receive the electrical signal from the switch 210. Based on the input level indicated by the electrical signal, the driver 220 may control each of the channels 221 and 222, such as by providing current, or a portion of current, to each channel (e.g., a current of about 50 mA to about 2000 mA on a channel). The two-channel driver 220 may be configured such that both channels 221 and 222 are controlled by a particular input, such as by providing a portion of an available current to each channel. In addition, the portion of current provided to each of the channels 221 and 222 may be adjusted based on adjustments to the input level. The available current may remain constant (or nearly constant) across adjustments, such as a total amount of current that is divided between channels. For instance, if the available current is 700 mA, the total amount of current provided to the combination of channels 221 and 222 may remain at about 1 mA during adjustments. For instance, each channel could receive about 350 mA, channel 221 could receive about 300 mA and channel 222 could receive about 400 mA, or any other combination of portions that total to about 700 mA, based on adjustments to the input level from the switch 210.

For example, the switch 210 may be positioned at a first position that is correlated with a maximum input level (e.g., about 10 V). Based on the maximum input level, the driver 220 may provide all (or nearly all) of an available current to channel 221 and withhold all (or nearly all) of the available current from channel 222. The switch 210 may be adjusted to a second position that is correlated with a minimum input level (e.g., about 0 V). Based on the minimum input level, the driver 220 may withhold all (or nearly all) of the available current from channel 221 and provide all (or nearly all) of the available current to channel 222. In addition, the switch 210 may be adjusted to an intermediate position or may pass through a range of intermediate positions that are correlated with a range of intermediate input levels (e.g., between about 0 V to about 10 V), such as while the handle of the switch is moved between the maximum to the minimum positions. Based on the intermediate input level, the driver 220 may provide a first portion of the available current to channel 221 and a second portion of the available current from channel 222. For example, if the input level is about 50% (e.g., correlated with a middle switch position), the driver 220 may provide about half of the available current to the channel 221 and about half to the channel 222.

In some implementations, a lighting fixture, such as the lighting fixture 200, may provide multiple proximal lighting effects at multiple areas of the lighting fixture, such as proximal effects that are visible to a person viewing the lighting fixture. The proximal effects may be provided within an effect range from the lighting fixture 200 (e.g., within a distance of about 20 cm). In addition, adjustments to the multiple proximal lighting effects may be provided at the areas that correspond to the adjustments, such that the area (or areas) of the lighting effects changes based on the adjustments. For example, a respective area(s) where a particular proximal effect is visible may change (e.g., size, shape, location) based on a given input received by the lighting fixture. In addition, the respective areas for multiple proximal lighting effects may each change respectively based on the given input. In some cases, the multiple proximal lighting effects are combined to provide a combined lighting effect. The combined lighting effect may be provided as an additional proximal effect at an additional area of the lighting fixture, or as a distal effect at an area remote from the lighting fixture (e.g., outside of the effect range). The combined lighting effect may remain stable across adjustments to component lighting effects on which the combined effect is based. For example, the combined lighting effect may have a stable color, color temperature, distribution, or other lighting effect across adjustments to the multiple proximal lighting effects.

Figure 3:
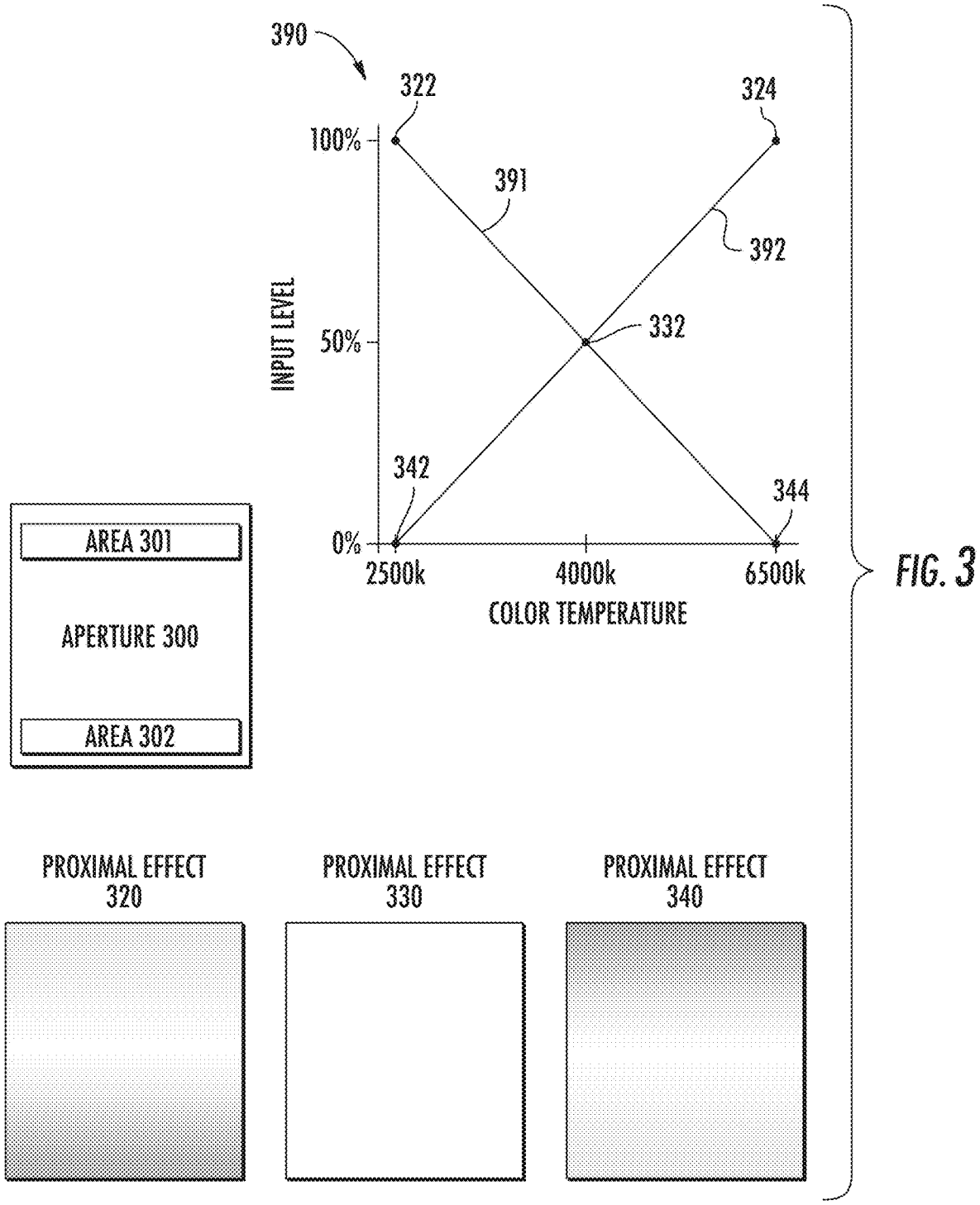
FIG. 3 is a block diagram depicting examples of adjustments to proximal lighting effects, such as color effects, provided by a lighting fixture, according to certain implementations.

FIG. 3 depicts examples of adjustments to proximal lighting effects provided by a lighting fixture. For example, a lighting fixture may provide adjustments to multiple color effects that are provided within an effect range from the lighting fixture. For convenience, and not by way of limitation, some aspects of FIG. 3 are described with regards to example implementations as described in FIG. 2, but other implementations are possible.

In FIG. 3, one or more proximal lighting effects may be viewed via an aperture 300 of a lighting fixture. In some cases, the aperture 300 is included in the lighting fixture 200. The aperture 300 may have a location relative to multiple areas of the lighting fixture in which emitters are arranged. The aperture 300 may be located such that lighting effects provided by the emitters are provided through the aperture 300. For example, the aperture 300 may be located in the lighting fixture 200 such that lighting effects produced by the subgroups 230 and 245 are provided at an area 301, and that lighting effects produced by the subgroups 240 and 235 are provided at an area 302. FIG. 3 depicts areas 301 and 302 as having horizontal orientations, but any suitable orientation or form factor may be implemented. In some cases, a lighting fixture may be arranged such that emitters provide a respective lighting effect directed through the aperture 300, such as an LED that is arranged to direct light towards and through the aperture. In addition, a lighting fixture may be arranged such that emitters provide a respective lighting effect indirectly through the aperture 300, such as an additional LED that is arranged to direct light towards a reflective surface, via which the effect is directed through the aperture.

In some implementations, the aperture 300 provides multiple adjustable proximal effects, such as a proximal effect 320, a proximal effect 330, and a proximal effect 340. The proximal effects 320, 330, and 340 may be visible at the aperture 300, such as to a person viewing the aperture 300. For convenience and not by way of limitation, the proximal effects 320, 330, and 340 are depicted with respect to a front view of the aperture 300. The proximal effects 320, 330, and 340 may be based on multiple lighting effects provided at the areas 301 and 302, such as a lighting effect (or combined lighting effect) provided by multiple ones of the subgroups 230, 240, 235, or 245. In some cases, the proximal effects provided by the aperture 300 may be adjustable based on an input received by the lighting fixture, such as an input received by the lighting fixture 200 from the switch 210. In addition, a particular proximal effect provided at particular area of the aperture 300 may be adjustable based on the input.

In FIG. 3, the proximal effects 320, 330, and 340 may be based on color effects, such as colors or color temperatures associated with the LED subgroups 230, 240, 235, and 245. For example, the subgroups 230 and 235 may be capable of producing light having a yellow color with a color temperature of about 2500 K. In addition, the subgroups 240 and 245 may be capable of producing light having a blue color with a color temperature of about 6500 K. The proximal effects 320, 330, and 340 may be based on light having the blue color, the yellow color, or a combination of blue and yellow. In some cases, adjustments to the proximal effects may correspond to an input received by the lighting fixture, such as depicted in the example graph 390. In the graph 390, the line 391 may indicate a color temperature of light emitted at the area 301 (e.g., by the subgroups 230 and/or 245). In addition, the line 392 may indicate a color temperature of light emitted at the area 302 (e.g., by the subgroups 240 and/or 235).

The proximal effect 320 may correspond to a maximum input level received by the lighting fixture. For example, the lighting fixture 200 may receive from the switch 210 a first input level of about 100%, corresponding to the points 322 and 324 on graph 390. Responsive to receiving the first input level, the driver 220 may provide current to channel 221 and withhold current from channel 222. Based on the current received via channel 221, the LED subgroup 230 may emit light having the yellow color, and the LED subgroup 240 may emit light having the blue color. The yellow light may be provided via area 301 of the aperture 300, and the blue light may be provided via area 302, such as depicted in the proximal effect 320. In the proximal effect 320, additional effects, such as a light having a white color with a color temperature of about 4000 K (e.g., based on a combination of blue and yellow light) or a color gradient may also be provided at additional areas of the aperture 300, such as in a transitional area located between the areas 301 and 302. In some cases, the transitional area is a center area of the aperture 300, but other implementations are possible. For example, if the areas 301 and 302 were to be arranged perpendicular to each other (e.g., in a cross, in an L-shape), the transitional area could be located at an intersection of the areas 301 and 302.

The proximal effect 330 may correspond to a middle input level (e.g., about halfway between maximum and minimum) received by the lighting fixture. For example, the lighting fixture 200 may receive from the switch 210 a second input level of about 50%, corresponding to the point 332 on graph 390. Responsive to receiving the second input level, the driver 220 may provide a portion (e.g., about 50%) of current to channel 221 and provide another portion (e.g., about 50%) of current to channel 222. Based on the current received via the channels 221 and 222, the LED subgroups 230 and 235 may emit light having the yellow color, and the LED subgroups 240 and 245 may emit light having the blue color. Light having combination of the yellow and blue colors, such as light having the white color, may be provided via areas 301 and 302 of the aperture 300. In the proximal effect 330, the white color may be the only proximal effect provided at the aperture 300.

The proximal effect 340 may correspond to a minimum input level received by the lighting fixture. For example, the lighting fixture 200 may receive from the switch 210 a third input level of about 0%, corresponding to the points 342 and 344 on graph 390. Responsive to receiving the third input level, the driver 220 may withhold current from channel 221 and provide current to channel 222. Based on the current received via channel 222, the LED subgroup 235 may emit light having the yellow color, and the LED subgroup 245 may emit light having the blue color. The blue light may be provided via area 301 of the aperture 300, and the yellow light may be provided via area 302, such as depicted in the proximal effect 340. In the proximal effect 340, additional effects, such as a color gradient or light having the white color may also be provided at additional areas of the aperture 300, such as in the transitional area located between the areas 301 and 302.

In some cases, proximal effects provided at the lighting fixture are adjusted. In the graph 390, the lines 391 and 392 may indicate the color temperature of proximal effects provided at areas 301 and 302, respectively. For example, the maximum input level, corresponding to points 322 and 324, may be adjusted towards the minimum level, corresponding to points 342 and 344. Responsive to the level adjustment, the driver 220 may adjust the current, such as by withholding a portion of current from channel 221 and providing a portion of current to channel 222. Based on the current adjustment, light emitted in the area 301 may include an increased amount of blue color (e.g., current is provided to subgroup 245) and a decreased amount of yellow color (e.g., current is withheld from subgroup 230). Line 391 may indicate the change in the color temperature provided at area 301, such as a change from a color temperature of 2500 K at point 322 towards a cooler color temperature present on the line 391 (e.g., point 332, point 344). In addition, based on the current adjustment, light emitted in the area 302 may include an increased amount of yellow color (e.g., current is provided to subgroup 235) and a decreased amount of blue color (e.g., current is withheld from subgroup 240). Line 392 may indicate the change in the color temperature provided at area 302, such as a change from a color temperature of 6500 K at point 324 towards a warmer color temperature present on the line 392 (e.g., point 332, point 342).

In some cases, a proximal effect, such as the proximal effects 320 and 340, may have multiple component effects that are provided at various areas of the aperture 300. In the proximal effect 320, for instance, area 301 may emit light with the yellow color and area 302 may emit light with the blue color. Additional areas adjoining the area 301 (or 302) may emit light with the yellow (or blue) color, or nearly the same color. In addition, additional areas that are between the areas 301 and 302 may provide a proximal effect based on a combination of the proximal effects provided at the areas 301 and 302, such as the white color that includes the component colors blue and yellow, or a color gradient from blue to yellow or from blue to white to yellow. Each component effect in the proximal effect 320 (such as the blue and yellow colors, the white color, and the color gradient) may be visually distinct at the aperture 300, such as to a person viewing the lighting fixture. In addition, the proximal components may be adjusted, such as increasing or decreasing component effects of blue, yellow, or white colors, as described above.

In some implementations, the aperture 300 may provide a combined lighting effect that is a combination of the multiple proximal effects. In addition, the combined lighting effect may remain stable across adjustments to the multiple proximal effects. In the proximal effect 330, for instance, the areas 301 and 302 may each emit light with the white color, such as with the color temperature of about 4000 K. In addition, the white color provided in effect 330 may be the same, or nearly the same, as the white color provided in effects 320 and 340. For example, as the input level is adjusted, such as depicted in graph 390, a combined color temperature, such as the average of lines 391 and 392, remains the same or nearly the same, such as at a combined color temperature of about 4000 K.

The combined lighting effect may be a proximal lighting effect, such as the white color provided in effects 320, 330, and 340. In addition, the combined lighting effect may be a distal lighting effect that is provided at a location that is remote from the aperture 300 and the lighting fixture. The distal lighting effect may be provided at a location that is outside of an effect range from the aperture 300, such as at a work surface located below the aperture 300, or another surface configured to receive light emitted via the aperture 300. In addition, the distal effect may remain stable across adjustments to the lighting fixture, such as a color temperature of about 4000 K across adjustments across the proximal effects 320, 330, or 340. In some cases, the distal effect is a functional effect, such as the functional effect of white task lighting at the work surface.

Figure 4:
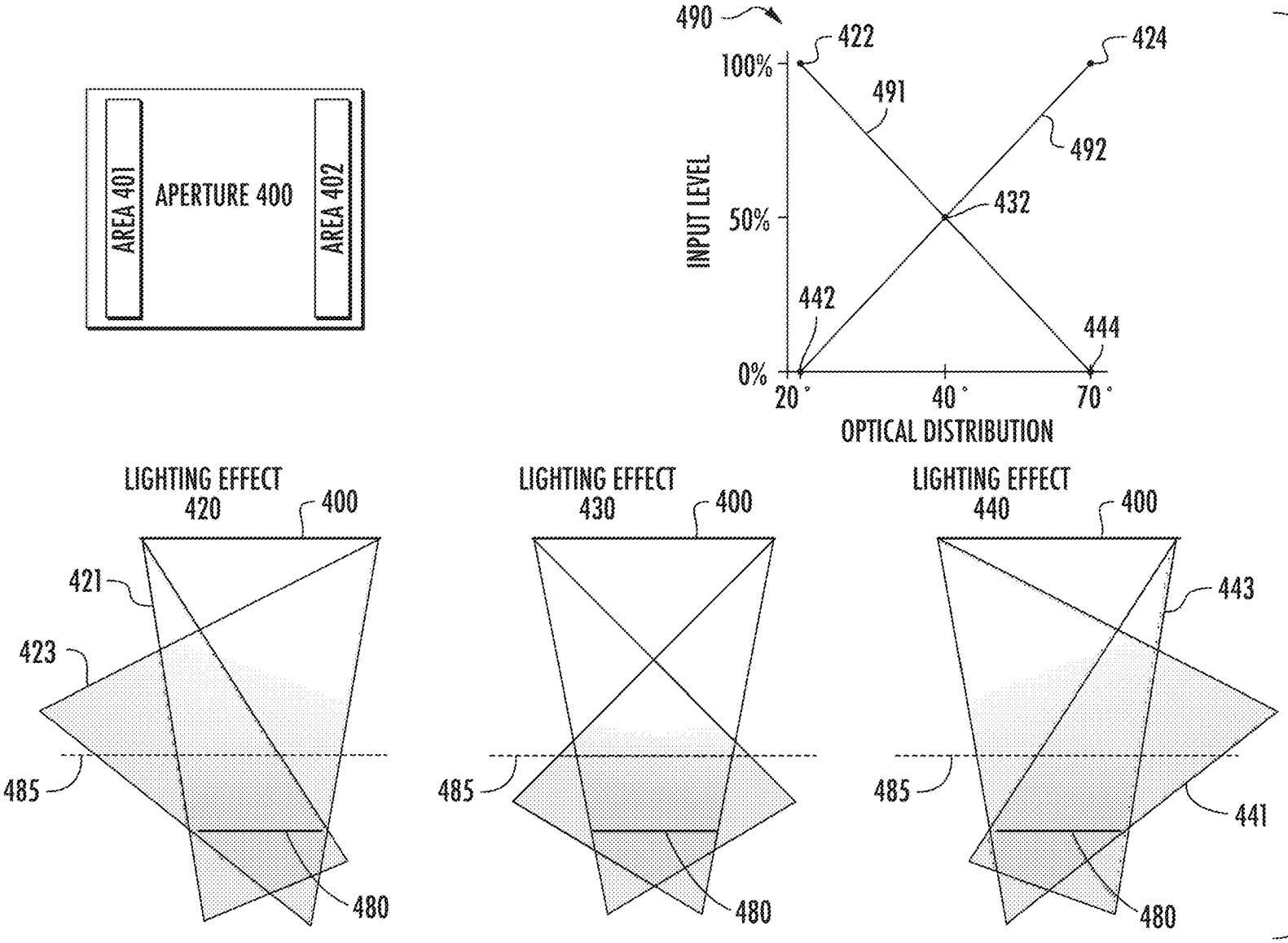
FIG. 4 is a block diagram depicting examples of adjustments to lighting effects, such as distribution effects, provided by a lighting fixture, according to certain implementations.

FIG. 4 depicts additional examples of adjustments to proximal and distal lighting effects provided by a lighting fixture. For example, a lighting fixture may provide adjustments to multiple distribution effects. For convenience, and not by way of limitation, some aspects of FIG. 4 are described with regards to example implementations as described in FIGS. 2 and 3, but other implementations are possible.

In FIG. 4, one or more proximal lighting effects may be provided via an aperture 400 of a lighting fixture. In some cases, the aperture 400 is included in the lighting fixture 200. The aperture 400 may have a location relative to multiple areas of the lighting fixture in which emitters are arranged. The aperture 400 may be located such that lighting effects provided by the emitters are provided through the aperture 400. In some cases, multiple types of lighting effects may be provides via the aperture 400. For example, if the aperture 300 and the aperture 400 are included in the lighting fixture 200 (e.g., a same aperture, a set of apertures), color effects and distribution effects could both be provided by the fixture, via the apertures 300 and 400.

The aperture 400 may be located in the lighting fixture 200 such that lighting effects produced by the subgroups 230 and 245 are provided at an area 401, and that lighting effects produced by the subgroups 240 and 235 are provided at an area 402. FIG. 4 depicts areas 401 and 402 as having vertical orientations, but any suitable orientation or form factor may be implemented, including implementations in which area 401 is similar or the same as area 301 and area 402 is similar or the same as area 302. The lighting fixture 200 may be arranged such that emitters direct a respective lighting effect through the aperture 400, or indirectly through the aperture 400 (e.g., via one or more reflective surfaces in the lighting fixture). In some implementations, multiple lighting effects are provided by subgroups of LEDs. For example, an LED subgroup may provide a color effect, and the subgroup (or an additional subgroup) may provide a distribution effect. In some cases, multiple lighting effects are provided via respective direct or indirect techniques. For example, a subgroup that provides a color effect may direct the color effect towards and through the aperture, and an additional subgroup that provides a distribution effect may indirectly provide the distribution effect, via one or more reflective surfaces.

In some implementations, the aperture 400 provides multiple adjustable lighting effects, such as a lighting effect 420, a lighting effect 430, and a lighting effect 440. For convenience and not by way of limitation, the lighting effects 420, 430, and 440 are depicted with respect to a side view of the aperture 400. The lighting effects 420, 430, and 440 may include multiple proximal effects provided at the areas 401 and 402, such as a proximal effect (or combined proximal effect) provided by multiple ones of the subgroups 230, 240, 235, or 245. In addition, the lighting effects 420, 430, and 440 may include at least one distal effect provided at a location remote from the aperture 400, such as at a work surface 480. The proximal effects may be provided within an effect range from the aperture 400, such as an effect range 485. The distal effect(s) may be provided outside of the effect range 485. In some cases, the lighting effects provided by the aperture 400 may be adjustable based on an input received by the lighting fixture, such as an input from the switch 210. In addition, a particular proximal effect provided at particular area of the aperture 400 may be adjustable based on the input.

In FIG. 4, the lighting effects 420, 430, and 440 may be based on distribution effects, such as optical distributions or distribution angles associated with the LED subgroups 230, 240, 235, and 245. For example, the subgroups 230 and 235 may be capable of producing light having a relatively narrow angle of optical distribution of about 20 degrees. In addition, the subgroups 240 and 245 may be capable of producing light having a relatively wide angle of optical distribution of about 70 degrees. The lighting effects 420, 430, and 440 may be based on light having the wider angle, the narrower angle, or a combination of the optical distribution angles. In some cases, adjustments to the lighting effects may correspond to an input received by the lighting fixture, such as depicted in the example graph 490. In the graph 490, the line 491 may indicate an angle of light emitted at the area 401 (e.g., by the subgroups 230 and/or 245). In addition, the line 492 may indicate an angle of light emitted at the area 402 (e.g., by the subgroups 240 and/or 235).

The lighting effect 420 may correspond to a maximum input level received by the lighting fixture. For example, the lighting fixture 200 may receive from the switch 210 a first input level of about 100%, corresponding to the points 422 and 424 on graph 490. Responsive to receiving the first input level, the driver 220 may provide current to channel 221 and withhold current from channel 222. Based on the current received via channel 221, the LED subgroup 230 may emit light having the narrower angle, and the LED subgroup 240 may emit light having the wider angle. The light having the narrower angle may be provided via area 401 of the aperture 400, such as a narrow-angle effect 421, and the light having the wider angle may be provided via area 402, such as a wide-angle effect 423. For example, as depicted in the lighting effect 420, area 401 may emit the narrow-angle effect 421 in a direction that is directed (or mostly directed) towards the work surface 480. In addition, area 402 may emit the wide-angle effect 423 in a direction that is dispersed away (or partially away) from the work surface 480, such as towards a nearby wall or other surface. Within the effect range 485 from the aperture 400, the effects 421 and 423 may each provide a proximal effect. In addition, a combined lighting effect that includes the wide-angle effect 423 and the narrow-angle effect 421 may be provided outside of the effect range 485, such as at the work surface 480.

The lighting effect 430 may correspond to a middle input level received by the lighting fixture. For example, the lighting fixture 200 may receive from the switch 210 a second input level of about 50%, corresponding to the point 432 on graph 490. Responsive to receiving the second input level, the driver 220 may provide a portion (e.g., about 50%) of current to channel 221 and provide another portion (e.g., about 50%) of current to channel 222. Based on the current received via the channels 221 and 222, the LED subgroups 230 and 235 may emit light having the narrower angle, and the LED subgroups 240 and 245 may emit light having the wider angle. Light having combination of the wide and narrow angles may be provided via areas 401 and 402 of the aperture 400. In the lighting effect 430, the combined angles of optical distribution may be a proximal effect provided at the aperture 400, within the effect range 485. In addition, a distal effect based on the combined angles may be provided outside of the effect range 485, such as at the work surface 480 and at one or more nearby walls (or other surfaces remote from the lighting fixture).

The lighting effect 440 may correspond to a minimum input level received by the lighting fixture. For example, the lighting fixture 200 may receive from the switch 210 a third input level of about 0%, corresponding to the points 442 and 444 on graph 490. Responsive to receiving the third input level, the driver 220 may withhold current from channel 221 and provide current to channel 222. Based on the current received via channel 222, the LED subgroup 235 may emit light having the narrower angle, and the LED subgroup 245 may emit light having the wider angle. The light having the wider angle may be provided via area 401 of the aperture 400, such as a wide-angle effect 441, and the light having the narrower angle may be provided via area 402, such as a narrow-angle effect 443. For example, as depicted in the lighting effect 440, area 402 may emit the narrow-angle effect 443 in a direction that is directed (or mostly directed) towards the work surface 480. In addition, area 401 may emit the wide-angle effect 441 in a direction that is dispersed away (or partially away) from the work surface 480, such as towards a nearby wall or other surface. Within the effect range 485 from the aperture 400, the effects 441 and 443 may each provide a proximal effect. In addition, a combined lighting effect that includes the wide-angle effect 441 and the narrow-angle effect 443 may be provided outside of the effect range 485, such as at the work surface 480. In some implementations, an optical distribution (or a distribution angle) is provided by a group of LEDs that have a particular direction. For example, the LED subgroup 235 may be configured to direct light at the narrower angle, and the LED subgroup 245 may be configured to direct light at the wider angle. In addition, the optical distribution (or distribution angle) is provided by light reflected, or otherwise distributed, from one or more surfaces having a particular configuration relative to a group of LEDs. For example, a first reflective surface may be configured to reflect light from the LED subgroup 235 at the narrower angle, and a second reflective surface may be configured to reflect light from the LED subgroup 245 at the narrower angle.

In some cases, adjustments to lighting effects are provided at the lighting fixture. In the graph 490, the lines 491 and 492 may indicate the angle of optical distribution for lighting effects visible via areas 401 and 402, respectively. For example, the maximum input level, corresponding to points 422 and 424, may be adjusted towards the minimum level, corresponding to points 442 and 444. Responsive to the level adjustment, the driver 220 may adjust the current, such as by withholding a portion of current from channel 221 and providing a portion of current to channel 222. Based on the current adjustment, light emitted via the area 401 may include an increased amount of light having the wider distribution angle (e.g., current is provided to subgroup 245) and a decreased amount of light having the narrower distribution angle (e.g., current is withheld from subgroup 230). Line 491 may indicate the change in the optical distribution provided via area 401, such as a change from a relatively narrow angle of 20 degrees at point 422 towards a wider angle present on the line 491 (e.g., point 432, point 444). In addition, based on the current adjustment, light emitted in the area 402 may include an increased amount of light having the narrower distribution angle (e.g., current is provided to subgroup 235) and a decreased amount of light having the wider distribution angle (e.g., current is withheld from subgroup 240). Line 492 may indicate the change in the optical distribution provided via area 402, such as a change from a relatively wide angle of about 70 degrees at point 424 towards a narrower angle present on the line 492 (e.g., point 432, point 442).

In some implementations, the aperture 400 may provide a distal lighting effect based on a combination of multiple proximal effects. In addition, the distal effect may remain stable across adjustments to the multiple proximal effects. In the lighting effect 430, for instance, the areas 401 and 402 may each emit light with the narrower angle, such as with the angle of about 20 degrees. In lighting effect 430, the optical distribution may be based on a combination of effects, such as a combination of wide- and narrow-angle effects which are provided by one or more of the subgroups 230, 240, 235, or 245. In addition, the narrower angle provided in effect 430 may be the same, or nearly the same, as the narrower angle visible in effects 420 and 440. For example, as the input level is adjusted, such as depicted in graph 490, a particular component of the combined optical distribution remains the same or nearly the same, such as the 20 degree angle present on lines 491 and 492 (e.g., at points 422 and 442). In addition, the combined angle, such as the average of lines 491 and 492, is adjusted across multiple angles, such as light that is adjusted from a first angle (e.g., light dispersed across 20 degrees emitted via area 401 and dispersed across 70 degrees emitted via area 402) to a second angle (e.g., light dispersed across 70 degrees emitted via area 401 and dispersed across 20 degrees emitted via area 402).

Figure 5:
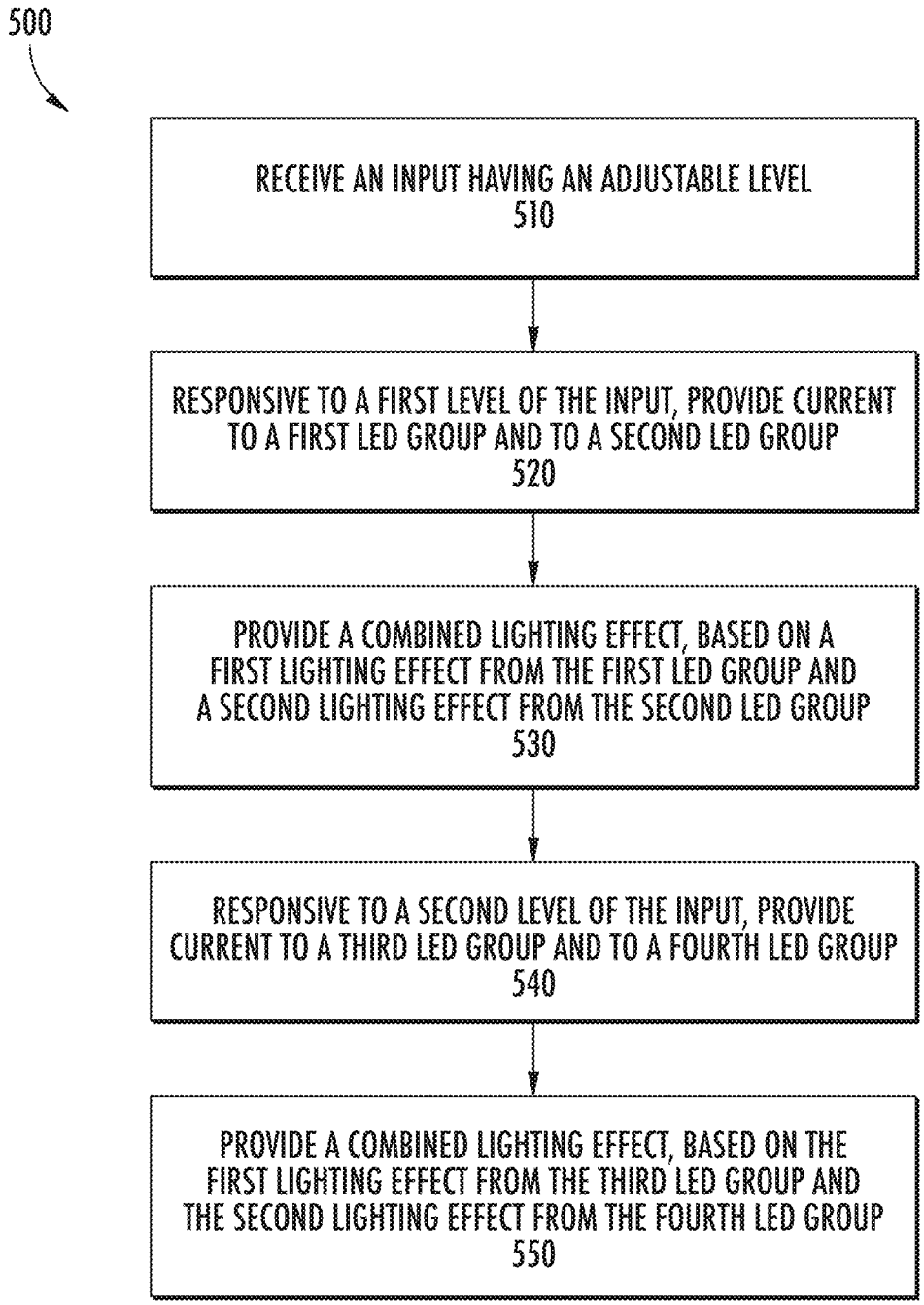
FIG. 5 is a flow chart depicting an example of a process for providing multiple adjustable lighting effects via a multi-channel driver, according to certain implementations.

FIG. 5 is a flow chart depicting an example of a process 500 for providing multiple adjustable lighting effects via a driver. In some implementations, such as described in regards to FIGS. 1-5, a lighting fixture having a multi-channel driver implements operations described in FIG. 5, by executing suitable program code. For illustrative purposes, the process 500 is described with reference to the examples depicted in FIGS. 1-4. Other implementations, however, are possible.

At block 510, the process 500 involves receiving an adjustable input. The input may include an adjustable level, such a level that is adjusted based on a position of a switch. In some implementations, the adjustable input level is received by a two-channel driver, such as the driver 220. The input level may be represented by an electrical signal, such as a digital signal or an analog signal. In addition, adjustments to the input level may be represented by adjustments to the electrical signal. For example, an adjustment to the input level may be based on an adjustment to a voltage, a current, a differential voltage, a differential current, or another electrical characteristic.

At block 520, the process 500 involves providing a current to multiple groups of emitters, such as LED groups. The current to the multiple LED groups may be provided responsive to receiving the adjustable input. In some implementations, responsive to receiving a first level of the adjustable input, current may be provided to a first LED group and a second LED group, such as via a channel of the two-channel driver. For example, responsive to receiving a first input level from the switch 210, the driver 220 may provide current to LED subgroups 230 and 240, such as via respective split terminals of the channel 221. In some cases, the current provided to the combination of the first and second LED groups may be a portion of available current, such as a portion that is based on the relative position of the switch (or a handle of the switch). For example, based on a maximum position of the switch, the combination of the first and second LED groups may receive about 100% of the available current. In addition, based on an intermediate position of the switch (e.g., a position of about 70%), the combination of the first and second LED groups may receive an intermediate portion (e.g., about 70%) of the available current. In some cases, the portion of current received by the combination of the first and second LED groups may be divided between the groups via split terminals of the channel. For example, the portion of current that is received via channel 221 may be divided between the LED subgroups 230 and 240 via the split terminals 250 and 251.

At block 530, the process 500 involves providing a combined lighting effect, based on respective lighting effects of the multiple groups of emitters. In some implementations, the combined lighting effect is based on a first lighting effect provided from the first LED group and on a second lighting effect provided from the second LED group. In some cases, the combined lighting effect may include one or more proximal effects within an effect range, and one or more distal effects outside of the effect range. The proximal effects may include one or more component effects. For example, a proximal effect may include multiple component effects that are provided at an aperture, such as component proximal effects that are provided via areas 301, 401, 302, or 402. The component proximal effects may be provided within the effect range, such as the effect range 485. In addition, the distal effect may be based on a combination of the component effects. The distal effect may be provided at a location remote from the lighting fixture, such as outside the effect range 485 or at the work surface 480 (or both).

At block 540, the process 500 involves providing current to additional groups of emitters, such as additional LED groups. The current to the multiple additional LED groups may be provided responsive to receiving an additional level of the adjustable input. In some implementations, responsive to receiving a second level of the adjustable input, current may be provided to a third LED group and a fourth LED group, such as via an additional channel of the two-channel driver. For example, responsive to receiving a second input level from the switch 210, the driver 220 may provide current to LED subgroups 235 and 245, such as via respective split terminals of the channel 222. In some cases, the current provided to the combination of the third and fourth LED groups may be a portion of available current, such as a portion that is based on the relative position of the switch (or handle). For example, based on a minimum position of the switch, the combination of the third and fourth LED groups may receive about 100% of the available current. In addition, based on an intermediate position of the switch (e.g., a position of about 70%), the combination of the first and second LED groups may receive an intermediate portion (e.g., about 70%) of the available current, and the combination of the third and fourth LED groups may receive an additional intermediate portion (e.g., about 30%) of the available current. In some cases, the portion of current received by the combination of the third and fourth LED groups may be divided between the groups via split terminals of the channel. For example, the portion of current that is received via channel 222 may be divided between the LED subgroups 235 and 245 via the split terminals 260 and 261.

At block 550, the process 500 involves providing the combined lighting effect based on additional respective lighting effects of the additional groups of emitters. In some implementations, the combined lighting effect is based on the first lighting effect provided from the third LED group and on the second lighting effect provided from the fourth LED group, such as the first and second lighting effects as described in regards to block 530. In some implementations, the combined lighting effect, or the distal effect(s) included in the combined lighting effect, is stable (e.g., has a similar value) across the lighting effects provided by the multiple emitters and the additional emitters. For example, the distal effect of the combined lighting effect may be stable across the first and second lighting effects provided from the first, second, third, and fourth LED groups. A stable lighting effect may be understood as a lighting effect that has a similar value (e.g., color, distribution angle, color temperature) across adjustments to the lighting fixture. In some cases, the stable lighting effect may be visually similar to a person experiencing the lighting effect, such as a stable lighting effect having a color, color temperature, or distribution that remain within a visually similar range of color, color temperature, or distribution. In addition, the combined lighting effect may include a distal effect that is stable and one or more proximal effects that are adjustable, where the distal effect remains stable across the adjustments to the proximal effects.

Lighting Effects Via Additional Channels of a Multi-Channel Driver

In some implementations, a lighting fixture that includes a multi-channel driver with three or more channels may provide an additional adjustable lighting effect for each additional channel of the driver. In addition, all of the multiple adjustable lighting effects may be adjustable based on a particular input, such as an input received from a particular adjustable switch. For example, a lighting fixture that includes a three-channel driver may provide three adjustable lighting effects based on an input from a particular switch. A lighting fixture that includes a six-channel driver may provide six adjustable lighting effects, all of which are adjusted based on a particular input from a particular switch. In addition, the multiple lighting effects may be adjusted via the input received by the multi-channel driver, for instance, without modifying the input via a microcontroller.

Figure 6:
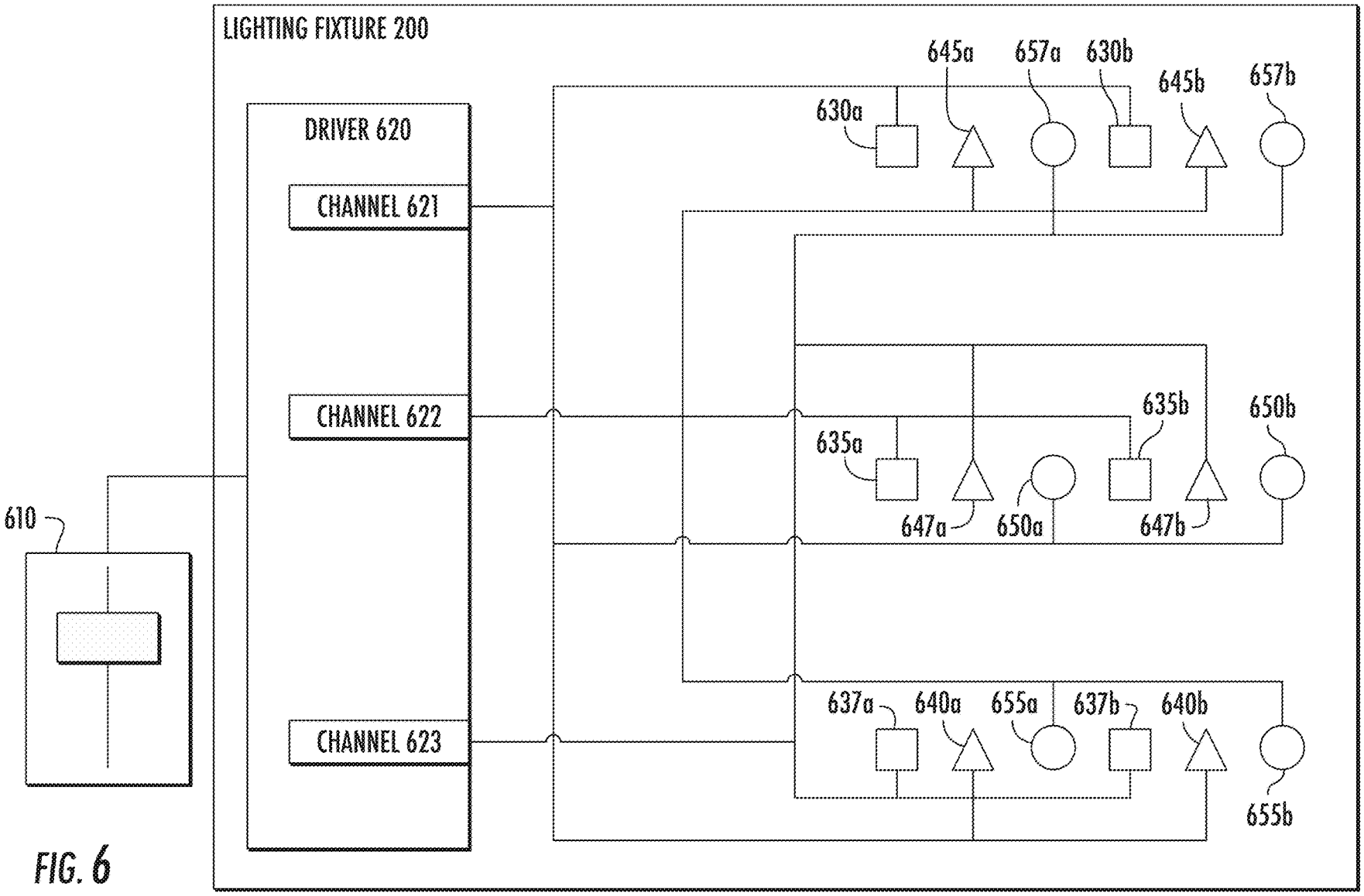
FIG. 6 is a block diagram depicting an example of a lighting fixture that is capable of providing multiple lighting effects via a multi-channel driver, according to certain implementations.

FIG. 6 includes a block diagram depicting an example of a lighting fixture that is capable of providing multiple lighting effects via multiple channels of a driver. The lighting fixture 600 may include a multi-channel driver 620, which includes a channel 621, a channel 622, and a channel 623. In addition, the lighting fixture 600 may include multiple emitters. For simplicity, the emitters included in the lighting fixture 600 are described as LEDs, but other implementations are possible, as described elsewhere herein.

The emitters in the lighting fixture 600 may provide multiple lighting effects. For example, the lighting fixture 600 may include a first plurality of LEDs that are capable of providing a first lighting effect. In addition, the lighting fixture 600 may include a second plurality of LEDs that are capable of providing a second lighting effect, and a third plurality of LEDs that are capable of providing a third lighting effect. The lighting fixture 600 may include an additional plurality of LEDs, capable of an additional respective lighting effect, for each additional channel in the multi-channel driver 620. For example, if the driver 620 includes seven channels, the lighting fixture 600 may include seven pluralities of emitters, each plurality capable of producing a respective lighting effect.

In FIG. 6, the first plurality of LEDs may include a subgroup 630, including LEDs 630*a* and 630*b*; a subgroup 635, including LEDs 635*a* and 635*b*; and a subgroup 637, including LEDs 637*a* and 637*b*. Each emitter in the subgroups 630, 635, and 637 may be capable of providing the first lighting effect. The second plurality of LEDs may include a subgroup 640, including LEDs 640*a* and 640*b*; a subgroup 645, including LEDs 645*a* and 645*b*; and a subgroup 647, including LEDs 647*a* and 647*b*. Each emitter in the subgroups 640, 645, and 647 may be capable of providing the second lighting effect. The third plurality of LEDs may include a subgroup 650, including LEDs 650*a* and 650*b*; a subgroup 655, including LEDs 655*a* and 655*b*; and a subgroup 657, including LEDs 657*a* and 657*b*. Each emitter in the subgroups 650, 655, and 657 may be capable of providing the third lighting effect. For convenience, FIG. 6 depicts emitters in the subgroups 630, 635, and 637 as squares; emitters in the subgroups 640, 645, and 647 as triangles; and emitters in the subgroups 650, 655, and 657 as circles. However, these diagrammatic shapes are non-limiting examples, and any suitable form factor may be used for an emitter.

In some implementations, emitters in the lighting fixture 600 are arranged in multiple areas of the fixture 600. For example, a first group of LEDs may be arranged in a first area of the fixture 600, the first group including the subgroups 630, 645, and 657. In addition, a second group of LEDs may be arranged in a second area of the fixture 600, the second group including the subgroups 635, 647, and 650. Furthermore, a third group of LEDs may be arranged in a third area of the fixture 600, the third group including the subgroups 637, 640, and 655. In some implementations, the lighting fixture 600 may include additional areas in which emitters having additional lighting effects may be arranged. For example, if the driver 620 includes four channels, the lighting fixture 600 may include at least four areas in which group of emitters having the first lighting effect, second lighting effect, third lighting effect, and a fourth lighting effect may be arranged (e.g., each area having a group including an emitter subgroup for each effect type). The areas may be separated within the light fixture 600. For example, the separated areas may be visually distinct, such that a person viewing the fixture at a distance (e.g., across a room, from floor to ceiling) may visually discern a given lighting effect from emitters arranged at a given area. In the fixture 600, the areas may be arranged at respective locations of the fixture, such as along an edge location, at a central location, at a peripheral location, in a radial location, or in any other suitable location of the fixture.

The driver 620 may be configured to provide power to the multiple emitters via multiple respective channels, such as channels 621, 622, and 623. Additional groups of emitters may be provided current via additional channels of the multi-channel driver 620. For example, the driver 620 may be configured to provide current via the channel 621 to LED subgroup 630 in the first area, subgroup 650 in the second area, and subgroup 640 in the third area. In some cases, each LED in the subgroups 630, 640, and 650 may be configured to receive current via a particular terminal of the channel 621, such as via a split terminal of the channel 621, or via a split terminal of a splitter circuit component having multiple output terminals. In addition, the driver 620 may be configured to provide current via the channel 622 to LED subgroups 645, 635, and 655 arranged respectively in the first, second, and third areas. In some cases, each LED in the subgroups 645, 635, and 655 may be configured to receive current via a particular terminal of the channel 622, such as via a split terminal of the channel 622 or of a splitter circuit component. Furthermore, the driver 620 may be configured to provide current via the channel 623 to LED subgroups 657, 647, and 637 arranged respectively in the first, second, and third areas. In some cases, each LED in the subgroups 657, 647, and 637 may be configured to receive current via a particular terminal of the channel 623, such as via a split terminal of the channel 623 or of a splitter circuit component.

Although FIG. 6 depicts the channels 621, 622, and 623 as providing current to their respective subgroups via a parallel configuration, other implementations are possible. For example, LED subgroups may be arranged in a serial configuration, such that a particular channel provides current to its respective subgroups in a series, via a particular terminal of the channel.

The lighting fixture 600 may be configured to receive an input, such as an input from an adjustable switch 610. The switch 610 may be configured to provide an input with an adjustable level, such as a level that is based on a position of a handle (or another user interface technique). For example, the switch 610 (or a handle) may have a range of possible positions (e.g., from a minimum position to a maximum position). The range of positions may be correlated with a range of input levels (e.g., from about 0% to about 100%). Based on the position, the switch 610 may provide an electrical signal that indicates the input level, such as a voltage between about 0 V to about 10 V. In FIG. 6, the electrical signal is described as a 0-10V voltage level, but other implementations are possible, as described elsewhere herein.

In some implementations, the driver 620 may receive the input level from the switch 610. Based on the input level, the driver 620 may control each of the channels 621, 622, and 623, such as by providing current, or a portion of current, to each channel. The multi-channel driver 620 may be configured such that some or all of the channels of the multi-channel driver are controlled by a particular input, such as by providing a portion of an available current to each channel based on the input level or a range of input levels. In addition, the portion of current provided to each channel may be adjusted based on adjustments to the input level. In some cases, each channel of the multi-channel driver 620 is correlated with a range of input levels, such that current provided via a particular channel is responsive to adjustments of the input level within the correlated range. In some cases, ranges of two (or more) channels may overlap, such that the channels receive a portion of current based on the input level within the overlapping ranges.

For example, the switch 610 may be positioned within a first range of positions that is correlated with a first range of input levels. Based on an input level that is within the first range, the driver 620 may provide a portion of available current to channel 621. Responsive to a first level within the first range, the driver 620 may provide all (or nearly all) available current to channel 621 and withhold all (or nearly all) of the available current from channels 622 and 623. In addition, based on an additional level within the first range, the driver 620 may provide a portion of available current to channel 621 and provide a portion of the available current to one or both of the channels 622 or 623. For example, based on adjustments to the input level within the first range, the driver 620 may provide a decreasing (or increasing) portion of current to channel 621 and an increasing (or decreasing) portion of current to a particular one of the channels 622 or 623.

The switch 610 may be adjusted to a second range of positions that is correlated with a second range of input levels. Based on an input level that is within the second range, the driver 620 may provide all (or nearly all) of an available current to channel 622 and withhold all (or nearly all) of the available current from channels 621 and 623. In addition, based on an additional level within the second range, the driver 620 may provide a portion of available current to channel 622 and provide a portion of the available current to one or both of the channels 621 or 623 (such as based on adjustments within the second range). In some cases, the second range, or a sub-section of the second range, may overlap with the first range or with a sub-section of the first range.

In addition, the switch 610 may be adjusted to a third range of positions that is correlated with a third range of input levels. Based on an input level that is within the third range, the driver 620 may provide all (or nearly all) of an available current to channel 623 and withhold all (or nearly all) of the available current from channels 621 and 622. In addition, based on an additional level within the third range, the driver 620 may provide a portion of available current to channel 623 and provide a portion of the available current to one or both of the channels 621 or 622 (such as based on adjustments within the second range). In some cases, the third range, or a sub-section of the third range, may overlap with the second range or with a sub-section of the second range. In some cases, the third range, or a sub-section of the third range, may overlap with additional ranges (e.g., associated with additional channels), or with the first range or with a sub-section of the first range.

Figure 7:
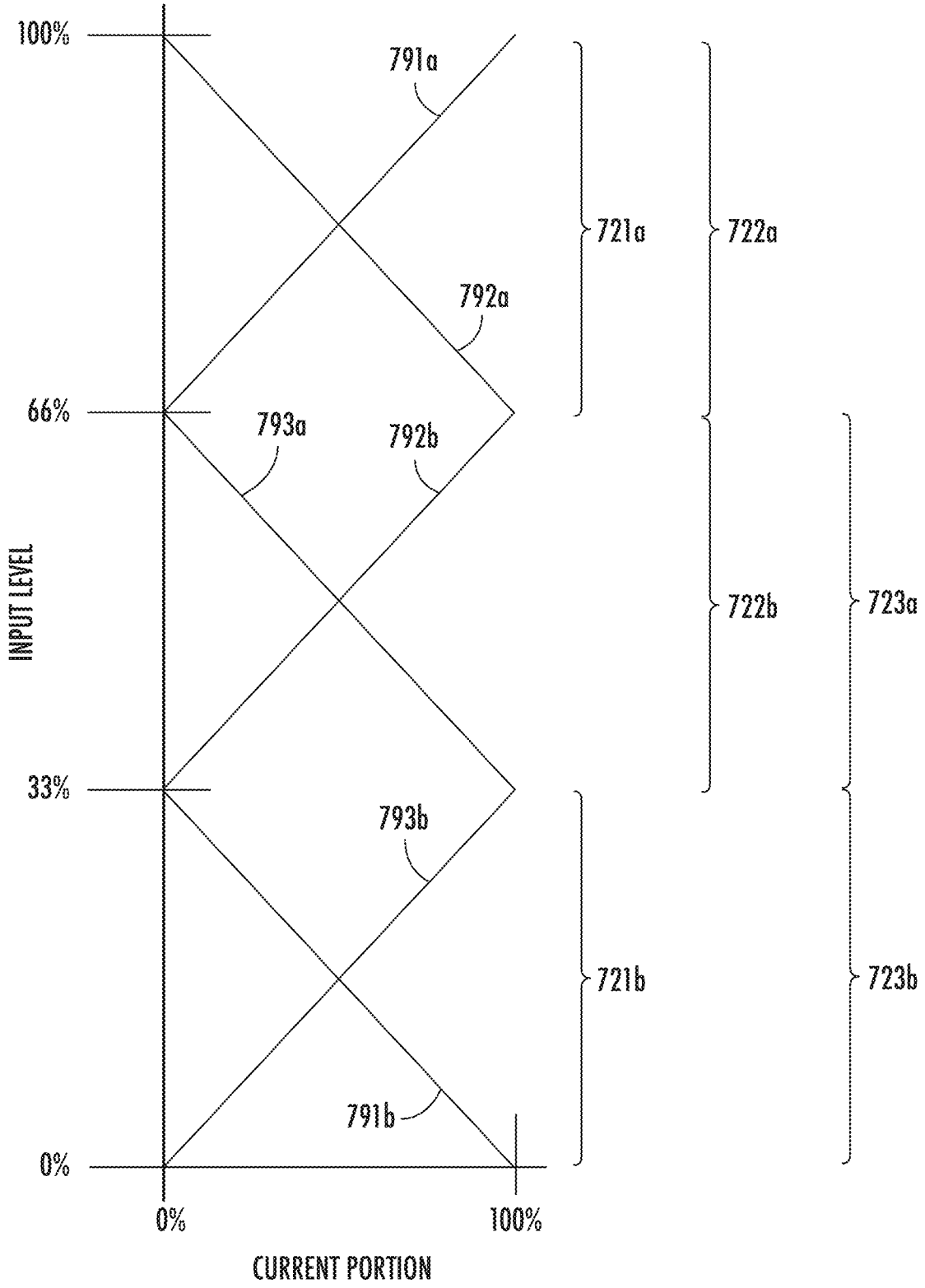
FIG. 7 is a graph depicting example ranges of an input level received by a multi-channel driver, according to certain implementations.
Figure 8:
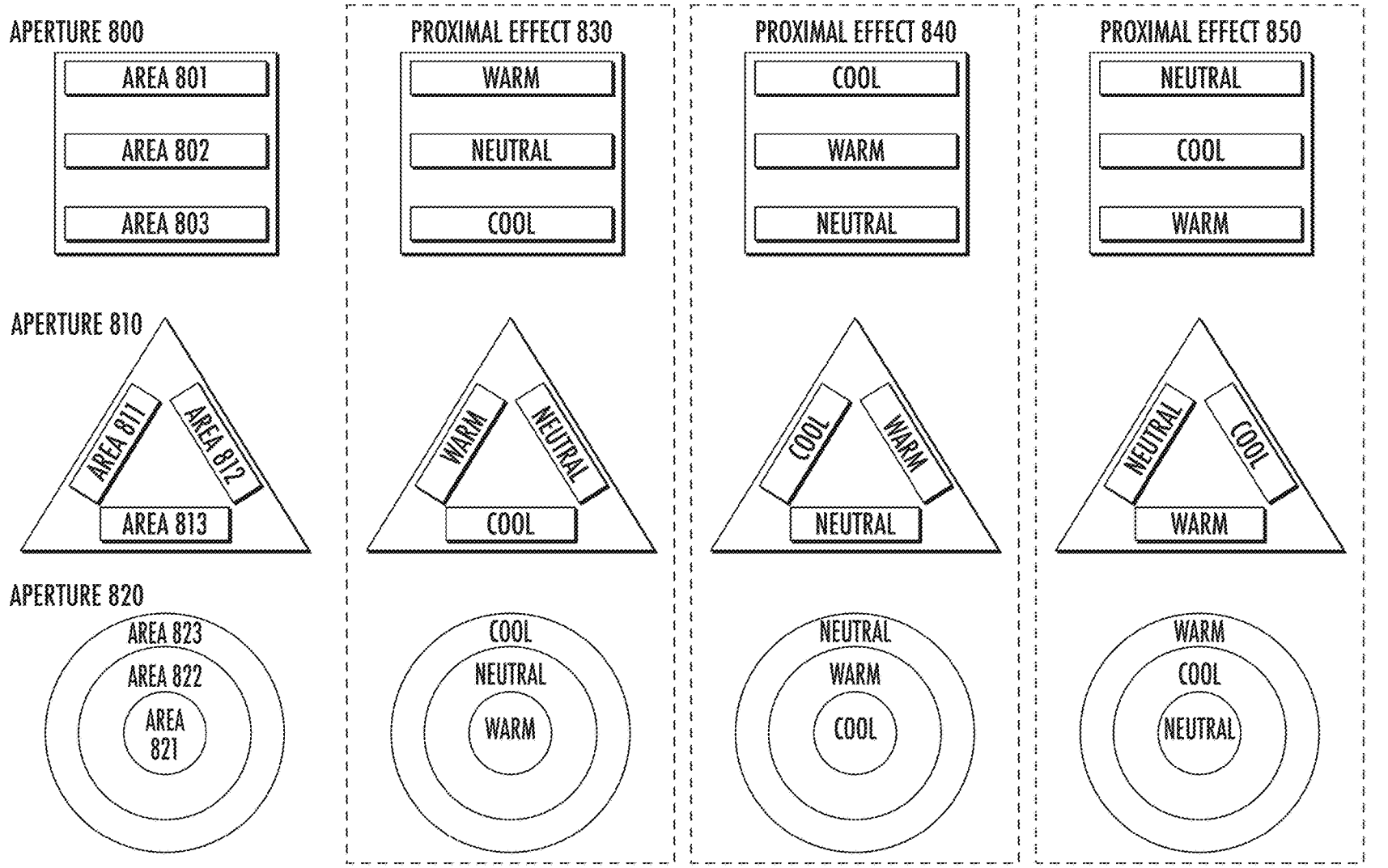
FIG. 8 is a block diagram depicting example arrangements of a lighting fixture, according to certain implementations.

FIG. 7 depicts example ranges of an input level. The input level may be received by a multi-channel driver, such as the multi-channel driver 620. FIG. 8 depicts example arrangements of an aperture of a lighting fixture, such as the lighting fixture 600. For convenience, and not by way of limitation, some aspects of FIGS. 7 and 8 are described with regards to example implementations as described in FIG. 6, but other implementations are possible.

In FIG. 7, graph 790 depicts example ranges of an input level provided by an adjustable switch, such as the switch 610. In graph 790, the input level may be adjusted between about 0% and about 100%, corresponding respectively to a minimum position and a maximum position of the switch (or a handle of the switch). The input level may have one or more ranges of values, such as value ranges that are associated with positions (or ranges of positions) of the switch. In addition, a range of values may be associated with a channel of a lighting fixture, such as the lighting fixture 600. For example, each of channels 621, 622, and 623 may be associated with a respective range of values depicted in the graph 790. In some cases, additional channels of the multi-channel driver may be associated with additional ranges of values (or ranges of positions).

In some implementations, a particular value range of the input level may have two or more sub-sections. For example, channel 622 may be associated with a value range 722, between about 100% of the input level to about 33% of the input level. The range 722 may have multiple subsections, including subsection 722*a* from about 100% to about 66% of the input level, and subsection 722*b* from about 66% to about 33% of the input level. In subsection 722*a*, a portion of current that is provided to the channel 622 by the driver 620 may increase, such as from about 0% of available current to about 100% of available current. In subsection 722*b*, a portion of current provided to the channel 622 may decrease, such as from about 100% to about 0% of available current. Channel 623 may be associated with a value range 723 with multiple subsections, including subsection 723*a* from about 66% to about 33% of the input level, and subsection 723*b* from about 33% to about 0% of the input level. In subsection 723*a*, a portion of current that is provided to the channel 623 by the driver 620 may increase, such as from about 0% to about 100% of available current. In subsection 723*b*, a portion of current provided to the channel 623 may decrease, such as from about 100% to about 0% of available current. In addition, channel 621 may be associated with a value range 721 with multiple subsections, including subsection 721*a* from about 100% to about 66% of the input level, and subsection 721*a* from about 33% to about 0% of the input level. In subsection 721*a*, a portion of current that is provided to the channel 621 by the driver 620 may decrease, such as from about 100% to about 0% of available current. In subsection 721*b*, a portion of current provided to the channel 621 may increase, such as from about 0% to about 100% of available current.

In some cases, a range of values, or a subsection of the range, associated with a particular channel may overlap with an additional range of values, or subsection, associated with an additional channel. In addition, a multi-channel driver, such as the driver 620, may provide a portion of available current to multiple channels, responsive to an input level within multiple ranges of values (or subsections) that are associated with the multiple channels. For example, responsive to an input level that is between about 100% and about 66%, the driver 620 may provide a portion of current to the channels 621 and 622 based on the overlapping ranges 721 and 722 associated with the respective channels. The driver 620 may provide to the channel 621 a portion of current corresponding to line 791*a* in the subsection 721*a*. In addition, the driver 620 may provide to the channel 622 a portion of current corresponding to the line 792*a* in the subsection 722*a*. Responsive to adjustments to the input level, the driver 620 may provide an adjusted portion of current to the channels 621 and 622, such as current portions indicated by the respective lines 791*a* and 792*a*.

In some cases, a multi-channel driver may provide current, or portions of current, to additional channels. For example, responsive to an input level (or adjusted input level) that is between about 66% and about 33%, the driver 620 may provide a portion of current to the channels 622 and 623 based on the overlapping ranges 722 and 723 associated with the respective channels. The portions of current provided to the channels 622 and 623 may be respectively indicated by line 792*b* in the subsection 722*b*, and line 793*a* in the subsection 723*a*. Responsive to an input level (or adjusted input level) that is between about 33% and about 0%, the driver 620 may provide a portion of current to the channels 623 and 621 based on the overlapping ranges 723 and 721 associated with the respective channels. The portions of current provided to the channels 623 and 621 may be respectively indicated by line 793*b* in the subsection 723*b*, and line 791*b* in this subsection 721*b*. In some cases, the multi-channel driver 620 may provide portions of current to additional channels based on additional ranges of values (or subsections ranges). In some cases, the multi-channel driver may provide current to a given number of channels. For example, the driver 620 may be configured to provide current to, at most, two channels based on a particular input level, such as a two-channel combination of the multiple channels 621, 622, and 623. Responsive to the input level, the two-channel combination may be based, for instance, on the current portions indicated in the graph 790.

In some implementations, a lighting fixture with a multi-channel driver may provide a combined lighting effect based on an input level that is within a range of values. For example, the lighting fixture 600 may provide a combined lighting effect responsive to an input level that has a value within the ranges 721, 722, and 723. In addition, the lighting fixture 600 may provide the combined lighting effect based on the value of the input level within multiple subsections of the ranges 271, 272, and 273. For example, if the input level has a value within the subsections 721*a* and 722*a*, the combined lighting effect may be based on lighting effects emitted by LEDs that receive current via, respectively, the channels 621 and 622. In addition, if the input level has a value within the subsections 722*b* and 723*a*, the combined lighting effect may be based on lighting effects emitted by LEDs that receive current via the respective channels 622 and 623. Furthermore, if the input level has a value within the subsections 723*b* and 721*b*, the combined lighting effects may be based on lighting effects emitted by LEDs that receive current via the respective channels 623 and 621.

In some cases, the combined lighting effect may be visible via multiple areas of an aperture in a lighting fixture, such as the lighting fixture 600. The combined lighting effect may include one or more proximal effects, such as proximal effects that are provided within an effect range from the lighting fixture. In addition, the combined lighting effects may include one or more distal effects, such as distal effects that are provided a location remote from the lighting fixture, outside of the effect range. In some cases, a particular one of the proximal effects is provided at a particular one of the multiple areas of the aperture, based on the value of the input level within the ranges 721, 722, and 723 (or subsections thereof).

In FIG. 8, one or more lighting effects may be provided via an aperture of a lighting fixture, such as an aperture 800, an aperture 810, or an aperture 820. The lighting effects may include one or more proximal effects provided within an effect range from the lighting fixture, one or more distal effects provided outside of the effect range, or both proximal and distal effects. Aperture 800 may include areas 801, 802, and 803, via which multiple lighting effects may be provided. Aperture 810 may include areas 811, 812, and 813, via which multiple lighting effects may be provided. Aperture 820 may include areas 821, 822, and 823, via which multiple aesthetic lighting effects may be provided. The aperture, such as the apertures 800, 810, or 820, may have a location relative to multiple areas of the lighting fixture in which emitters are arranged. The aperture may be located such that lighting effects provided by the emitters are provided through the aperture, such as at one or more areas included in the apertures 800, 810, or 820.

In some cases, the lighting fixture 600 includes an aperture, such as an aperture having one of the example configurations of the apertures 800, 810, or 820 For example, the aperture of the lighting fixture 600 may be configured such that lighting effects produced by the LED subgroups 630, 645, and 657 are provided at a first area, such as the area 801, area 811, or area 821 (e.g., respective to the configurations of apertures 800, 810, and 820). In addition, the aperture of the lighting fixture 600 may be configured such that lighting effects produced by the LED subgroups 635, 647, and 650 are provided at a second area, such as the area 802, 812, or 822. Further, the aperture of the lighting fixture 600 may be configured such that lighting effects produced by the LED subgroups 637, 640, and 655 are provided at a third area, such as the area 803, 813, or 823. In some cases, the aperture of the lighting fixture 600 may be configured to provide additional lighting effects at additional areas, such as at transitional areas between the first, second, and third areas; or at additional areas associated with additional LED groups and channels of the multi-channel driver 620.

One or more proximal effects provided by the lighting fixture 600 may be provided at respective areas of the aperture of the fixture 600. A particular proximal effect may be provided at a particular area of the aperture, based on the value of the input level received by the lighting fixture 600. In addition, the particular area (or areas) via which a proximal effect is provided may be correlated with a range of the input level, such as the ranges 721, 722, and 723. In some cases, the proximal effect is provided at the particular area (or areas) based on current provided to one or more channels that are associated with the range of the input level. For example, responsive to the input level being within a particular range associated with a particular channel, a group of LEDs that receives current via the particular channel may provide a particular combination of proximal effects via the areas correlated with the particular range.

In FIG. 7, the range 721 may be associated with the channel 621. Responsive to the input level being within one of the subsections of the range 721 (e.g., subsections 721*a*, 721*b*), the channel 621 may provide current (or a portion of current) to a first group of LEDs that includes the LED subgroups 630, 650, and 640. In addition, responsive to the input level being within the range 721 (or a subsection thereof), the LED subgroup 630 may provide a first lighting effect in a first area of the aperture of the lighting fixture 600, the LED subgroup 650 may provide a second lighting effect in a second area of the aperture, and the LED subgroup 640 may provide a third lighting effect in a third area of the aperture. For example, the first lighting effect may be provided via the area 801, 811, or 821 (e.g., respective to the configurations of apertures 800, 810, and 820); the second lighting effect may be provided via the area 802, 812, or 822; and the third lighting effect may be provided via the area 803, 813, or 823. As a non-limiting example, if the first lighting effect is a relatively warm color temperature (e.g., 2000 K), the second lighting effect is a relatively neutral color temperature (e.g., 4000 K), and the third lighting effect is a relatively cool color temperature (e.g., 6000 K), the warm color temperature may be provided via the area 801, the neutral color temperature may be provided via the area 802, and the cool color temperature may be provided via area 803 (e.g., relative to the configuration of aperture 800). Some non-limiting examples of a proximal effect provided by the first group of LEDs is illustrated in the group of proximal effects 830, for a lighting fixture having one of the configurations of apertures 800, 810, or 820. For example, the group of proximal effects 830 depicts examples of where the warm, neutral, and cool color effects might be provided, responsive to the input level being within the range 721.

In some implementations, the range 722 may be associated with the channel 622. Responsive to the input level being within one of the subsections of the range 722, the channel 622 may provide current (or a portion of current) to a second group of LEDs that includes the LED subgroups 645, 635, and 655. In addition, responsive to the input level being within the range 722 (or a subsection thereof), the LED subgroup 645 may provide the third lighting effect (e.g., the cool color temperature) in the first area of the aperture of the lighting fixture 600, the LED subgroup 635 may provide the first lighting effect (e.g., the warm color temperature) in the second area of the aperture, and the LED subgroup 655 may provide the second lighting effect (e.g., the neutral color temperature) in the third area of the aperture. For example, the first lighting effect may be provided via the area 802, 812, or 822; the second lighting effect may be provided via the area 803, 813, or 823; and the third lighting effect may be provided via the area 801, 811, or 821. Some non-limiting examples of a proximal effect provided by the second group of LEDs is illustrated in the group of proximal effects 840, for a lighting fixture having one of the configurations of apertures 800, 810, or 820. For example, the group of proximal effects 840 depicts examples of where the warm, neutral, and cool color effects might be provided, responsive to the input level being within the range 722.

In some implementations, the range 723 may be associated with the channel 623. Responsive to the input level being within one of the subsections of the range 723, the channel 623 may provide current (or a portion of current) to a third group of LEDs that includes the LED subgroups 647, 637, and 657. In addition, responsive to the input level being within the range 723 (or a subsection thereof), the LED subgroup 657 may provide the second lighting effect (e.g., the neutral color temperature) in the first area of the aperture of the lighting fixture 600, the LED subgroup 647 may provide the third lighting effect (e.g., the cool color temperature) in the second area of the aperture, and the LED subgroup 637 may provide the first lighting effect (e.g., the warm color temperature) in the third area of the aperture. For example, the first lighting effect may be provided via the area 803, 813, or 823; the second lighting effect may be provided via the area 801, 811, or 821; and the third lighting effect may be provided via the area 802, 812, or 822. Some non-limiting examples of a proximal effect provided by the second group of LEDs is illustrated in the group of proximal effects 850, for a lighting fixture having one of the configurations of apertures 800, 810, or 820. For example, the group of proximal effects 850 depicts examples of where the warm, neutral, and cool color effects might be provided, responsive to the input level being within the range 723.

In some cases, the combined lighting effect may be adjusted based on adjustments to the input level. In addition, the lighting fixture 600 may produce a combined lighting effect that is based on multiple ones of the proximal effects 830, 840, and 850. For example, responsive to the input level being within the overlapping subsections 721*a* and 722*a*, the fixture 600 may produce a combined lighting effect that is based on the component proximal effects 830 and 840, relative to a portion of current provided to channels 621 and 622 (e.g., as indicated by lines 791*a* and 792*a*). In addition, the fixture 600 may produce a combined lighting effect that is based on the component proximal effects 840 and 850 responsive to the input level being within the overlapping subsections 722*b* and 723*a*, and based on the component proximal effects 850 and 830 responsive to the input level being within the overlapping subsections 723*b* and 721*b*.

In some implementations, the aperture of the lighting fixture 600 may provide a distal lighting effect that is a combination of the multiple proximal effects. As a non-limiting example relative to the configuration of aperture 800, the warm, neutral, and cool example lighting effects may be provided via the areas 801, 802, and 803 (e.g., based on current portions indicated by graph 790). The distal lighting effect may be based on a combination of the multiple lighting effects, such as an averaged color temperature of 4000 K, based on an average of 2000 K, 4000 K, and 6000 K color temperatures of the warm, neutral, and cool effects. In this example, the distal lighting effect has an averaged color temperature that is identical to one of the component effects (e.g., 4000 K), but other implementations are possible. For example, the distal lighting effect may be a distinct effect from any one of the component effects, such as a distal effect with a color temperature (or other effect) that is different from any one of the component effects.

In addition, the distal effect provided by the lighting fixture 600 may remain stable across adjustments to the multiple proximal effects. Continuing with the above example, the averaged color temperature of the distal effect may remain stable across adjustments to the areas where the warm, neutral, and cool lighting effects are provided. As the input level is adjusted, for instance, the areas 801, 802, and 803 may provide the various proximal effects 830, 840, and 850, including the warm, neutral, or cool lighting effects (or combinations thereof). The distal lighting effect provided via the aperture 800 may remain stable at a location that is remote from the lighting fixture 600, such as a work surface that receives light emitted via the areas 801, 802, and 803.

General Considerations

Numerous specific details are set forth herein to provide a thorough understanding of the claimed subject matter. However, those skilled in the art will understand that the claimed subject matter may be practiced without these specific details. In other instances, methods, apparatuses, or systems that would be known by one of ordinary skill have not been described in detail so as not to obscure claimed subject matter.

Unless specifically stated otherwise, it is appreciated that throughout this specification discussions utilizing terms such as "processing," "computing," "calculating," "determining," and "identifying" or the like refer to actions or processes of a computing device, such as one or more computers or a similar electronic computing device or devices, that manipulate or transform data represented as physical electronic or magnetic quantities within memories, registers, or other information storage devices, transmission devices, or display devices of the computing platform.

The system or systems discussed herein are not limited to any particular hardware architecture or configuration. A computing device can include any suitable arrangement of components that provides a result conditioned on one or more inputs. Suitable computing devices include multipurpose microprocessor-based computer systems accessing stored software that programs or configures the computing system from a general purpose computing apparatus to a specialized computing apparatus implementing one or more implementations of the present subject matter. Any suitable programming, scripting, or other type of language or combinations of languages may be used to implement the teachings contained herein in software to be used in programming or configuring a computing device.

Implementations of the methods disclosed herein may be performed in the operation of such computing devices. The order of the blocks presented in the examples above can be varied—for example, blocks can be re-ordered, combined, and/or broken into sub-blocks. Certain blocks or processes can be performed in parallel.

The use of "adapted to" or "configured to" herein is meant as open and inclusive language that does not foreclose devices adapted to or configured to perform additional tasks or steps. Additionally, the use of "based on" is meant to be open and inclusive, in that a process, step, calculation, or other action "based on" one or more recited conditions or values may, in practice, be based on additional conditions or values beyond those recited. Headings, lists, and numbering included herein are for ease of explanation only and are not meant to be limiting.

While the present subject matter has been described in detail with respect to specific implementations thereof, it will be appreciated that those skilled in the art, upon attaining an understanding of the foregoing, may readily produce alterations to, variations of, and equivalents to such implementations. Accordingly, it should be understood that the present disclosure has been presented for purposes of example rather than limitation, and does not preclude inclusion of such modifications, variations, and/or additions to the present subject matter as would be readily apparent to one of ordinary skill in the art.

What is claimed is:

1. A lighting fixture, comprising:

an aperture via which multiple lighting effects of the lighting fixture are provided, the aperture having a first edge area and a second edge area, wherein the first edge area and the second edge area are separated by a central area of the aperture;

a driver configured to provide current via a first channel and a second channel based on an input, the first channel having a first split terminal and a second split terminal, and the second channel having a third split terminal and a fourth split terminal; and a first plurality of light emitting diodes (LEDs) having a first lighting color; and a second plurality of LEDs having a second lighting color, wherein a first subgroup of the first plurality of LEDs is configured to receive current via the first split terminal and a second subgroup of the second plurality of LEDs is configured to receive current via the second split terminal, and wherein a third subgroup of the first plurality of LEDs is configured to receive current via the third split terminal and a fourth subgroup of the second plurality of LEDs is configured to receive current via the fourth split terminal, wherein the driver is further configured to:

responsive to a first level of the input, provide current via the first split terminal and the second split terminal, such that (i) the first lighting color is provided by the first subgroup at the first edge area, and (ii) the second lighting color is provided by the second subgroup at the second edge area, and responsive to a second level of the input, provide current via the third split terminal and the fourth split terminal such that (i) the first lighting color is provided by the third subgroup at the second edge area, and (ii) the second lighting color is provided by the fourth subgroup at the first edge area, and wherein, responsive to the first level of the input and to the second level of the input, the lighting fixture provides a combined lighting color that includes the first lighting color and the second lighting color, the combined lighting color being provided at the central area and at a location remote from the lighting fixture.

2. The lighting fixture of claim 1, the driver further configured to receive, from an adjustable switch, a range of values of the input, the range including the first level of the input and the second level of the input, the lighting fixture further configured to provide the combined lighting color at each value included in the range of values.

3. The lighting fixture of claim 1, wherein the first lighting color is a first color other than white, the second lighting color is a second color other than white, and the combined lighting color is a white color.

4. The lighting fixture of claim 1, wherein:

responsive to the first input level, the combined lighting color is based on a combination of the first lighting color provided by the first subgroup and the second lighting color provided by the second subgroup, and responsive to the second input level, the combined lighting color is based on a combination of the first lighting color provided by the third subgroup and the second lighting color provided by the fourth subgroup.

5. The lighting fixture of claim 1, wherein the first lighting color and the second lighting color are provided within a range from the aperture of the lighting fixture, and the combined lighting color is provided outside of the range.

6. The lighting fixture of claim 1, wherein the combined lighting color has a color temperature that is provided responsive to the first level of the input and to the second level of the input.

7. The lighting fixture of claim 1, the first plurality of LEDs further having a first lighting effect and the second plurality of LEDs further having a second lighting effect, wherein the first lighting effect and the second lighting effect are one or more of: optical distribution, distribution angle, circadian effect, tint, a TM-30 metric, or color rendering index (CRI).

8. A lighting fixture, comprising:

an aperture via which multiple lighting effects of the lighting fixture are provided, the aperture having a first area and a second area, wherein the first area and the second area are separated by a transitional area of the aperture;

a driver configured to provide current via a first channel and a second channel based on an input, the first channel having a first split terminal and a second split terminal, and the second channel having a third split terminal and a fourth split terminal; and a first plurality of light emitting diodes (LEDs) having a first lighting color; and a second plurality of LEDs having a second lighting color, wherein a first subgroup of the first plurality of LEDs is configured to receive current via the first split terminal and a second subgroup of the second plurality of LEDs is configured to receive current via the second split terminal, and wherein a third subgroup of the first plurality of LEDs is configured to receive current via the third split terminal and a fourth subgroup of the second plurality of LEDs is configured to receive current via the fourth split terminal, wherein the driver is further configured to:

responsive to a first level of the input, provide current via the first split terminal and the second split terminal, such that (i) the first lighting color is provided by the first subgroup at the first area, (ii) the second lighting color is provided by the second subgroup at the second area, and (iii) the transitional area provides each of the first lighting color, the second lighting color, and a combined lighting color including the first lighting color and the second lighting color, and responsive to a second level of the input, provide current via the third split terminal and the fourth split terminal such that (i) the first lighting color is provided by the third subgroup at the second area, (ii) the second lighting color is provided by the fourth subgroup at the first area, and (iii) the transitional area provides each of the first lighting color, the second lighting color, and the combined lighting color, and wherein, responsive to the first level of the input and to the second level of the input, the lighting fixture provides the combined lighting color at a location remote from the lighting fixture.

9. The lighting fixture of claim 8, the driver further configured to receive, from an adjustable switch, a range of values of the input, the range including the first level of the input and the second level of the input, the lighting fixture further configured to provide the combined lighting color at each value included in the range of values.

10. The lighting fixture of claim 8, wherein:

responsive to the first level of the input, the combined lighting color is based on a combination of the first lighting color provided by the first subgroup and the second lighting color provided by the second subgroup, and responsive to the second level of the input, the combined lighting color is based on a combination of the first lighting color provided by the third subgroup and the second lighting color provided by the fourth subgroup.

11. The lighting fixture of claim 8, wherein the first lighting color, the second lighting color, and the combined lighting color are each provided within an effect range from the aperture of the lighting fixture, and the combined lighting color is provided outside of the effect range.

12. The lighting fixture of claim 8, the first plurality of LEDs further having a first lighting effect and the second plurality of LEDs further having a second lighting effect, wherein the first lighting effect and the second lighting effect are one or more of: optical distribution, distribution angle, circadian effect, tint, a TM-30 metric, or color rendering index (CRI).

13. A lighting fixture, comprising:

an aperture via which multiple lighting effects of the lighting fixture are provided, the aperture having a first edge area and a second edge area, wherein the first edge area and the second edge area are located on opposing edges of the aperture;

a driver configured to provide current via a first channel and a second channel based on an input;

a first plurality of light emitting diodes (LEDs), wherein the first plurality of LEDs provides a first lighting effect; and a second plurality of LEDs, wherein the second plurality of LEDs provides a second lighting effect, wherein a first subgroup of the first plurality of LEDs and a second subgroup of the second plurality of LEDs are configured to receive current via the first channel, and wherein a third subgroup of the first plurality of LEDs and a fourth subgroup of the second plurality of LEDs are configured to receive current via the second channel, wherein the driver is further configured to:

responsive to a first level of the input, provide current via the first channel, such that (i) the first lighting effect is provided by the first subgroup at the first edge area, and (ii) the second lighting effect is provided by the second subgroup at the second edge area, and responsive to a second level of the input, provide current via the second channel such that (i) the first lighting effect is provided by the third subgroup at the second edge area, and (ii) the second lighting effect is provided by the fourth subgroup at the first edge area, and wherein, responsive to the first level of the input and to the second level of the input, the lighting fixture provides a combined lighting effect that includes the first lighting effect and the second lighting effect, the combined lighting effect being provided at a location remote from the lighting fixture.

14. The lighting fixture of claim 13, the driver further configured to receive, from an adjustable switch, a range of values of the input, the range including the first level of the input and the second level of the input, the lighting fixture further configured to provide the combined lighting effect based on the first lighting effect and the second lighting effect at each value included in the range of values.

15. The lighting fixture of claim 13, wherein:

responsive to the first level of the input, the combined lighting effect is based on a combination of the first lighting effect provided by the first subgroup and the second lighting effect provided by the second subgroup, and responsive to the second level of the input, the combined lighting effect is based on a combination of the first lighting effect provided by the third subgroup and the second lighting effect provided by the fourth subgroup.

16. The lighting fixture of claim 13, wherein the first edge area and the second edge area are separated by a central area of the aperture, and wherein the combined lighting effect is provided at the central area of the lighting fixture responsive to the first level of the input and to the second level of the input.

17. The lighting fixture of claim 13, wherein the combined lighting effect has a stable value that is provided responsive to the first level of the input and to the second level of the input.

18. The lighting fixture of claim 13, wherein the first lighting effect and the second lighting effect are one or more of: color, color temperature, optical distribution, distribution angle, circadian effect, tint, a TM-30 metric, or color rendering index (CRI).

19. A lighting fixture, comprising:

an aperture via which multiple lighting effects of the lighting fixture are provided, the aperture having a first area, a second area, and a third area, wherein the first area, the second area, and the third area are separated by at least one transitional area of the aperture;

a driver configured to provide current via a first channel, a second channel, and a third channel based on an input; and multiple light emitting diodes (LEDs), wherein a first plurality of the LEDs provides a first lighting effect, a second plurality of the LEDs provides a second lighting effect, and a third plurality of LEDs provides a third lighting effect, wherein a first group of the multiple LEDs is configured to receive current via the first channel, the first group including at least one LED of the first plurality arranged at the first area, at least one LED of the second plurality arranged at the second area, and at least one LED of the third plurality arranged at the third area, wherein a second group of the multiple LEDs is configured to receive current via the second channel, the second group including at least one LED of the first plurality arranged at the second area, at least one LED of the second plurality arranged at the third area, and at least one LED of the third plurality arranged at the first area, wherein a third group of the multiple LEDs is configured to receive current via the third channel, the third group including at least one LED of the first plurality arranged at the third area, at least one LED of the second plurality arranged at the first area, and at least one LED of the third plurality arranged at the second area, wherein the driver is further configured to:

responsive to receiving a first value within a first range of the input, provide current via the first channel such that the first lighting effect is provided at the first area, the second lighting effect is provided at the second area, and the third lighting effect is provided at the third area;

responsive to receiving a second value within a second range of the input, provide current via the second channel such that the first lighting effect is provided at the second area, the second lighting effect is provided at the third area, and the third lighting effect is provided at the first area; and responsive to receiving a third value within a third range of the input, provide current via the third channel such that the first lighting effect is provided at the third area, the second lighting effect is provided at the first area, and the third lighting effect is provided at the second area, and wherein, responsive to any of the first value, the second value, or the third value, the lighting fixture provides a combined lighting effect that includes the first lighting effect, the second lighting effect, and the third lighting effect, the combined lighting effect being provided at a location remote from the lighting fixture.

20. The lighting fixture of claim 19, wherein each of the first lighting effect, the second lighting effect, and the third lighting effect are provided within an effect range from the aperture of the lighting fixture, and the combined lighting effect is provided outside of the effect range.

21. The lighting fixture of claim 19, wherein:

responsive to the first value, the combined lighting effect is provided by the first group of the multiple LEDs, responsive to the second value, the combined lighting effect is provided by the second group of the multiple LEDs, and responsive to the third value, the combined lighting effect is provided by the third group of the multiple LEDs.

22. The lighting fixture of claim 19, wherein the combined lighting effect is provided at the location remote from the lighting fixture responsive to the input being within any of the first range, the second range, or the third range.

23. The lighting fixture of claim 19, wherein the first lighting effect, the second lighting effect, and the second lighting effect are one or more of: color, color temperature, optical distribution, distribution angle, circadian effect, tint, a TM-30 metric, or color rendering index (CRI).

* * * * *